US006794801B2

(12) United States Patent
Yasuda et al.

(10) Patent No.: US 6,794,801 B2
(45) Date of Patent: Sep. 21, 2004

(54) COMPACT SELFBALLASTED FLUORESCENT LAMP AND LUMINAIRE

(75) Inventors: Takeo Yasuda, Kanagawa-ken (JP); Masahiro Toda, Kanagawa-ken (JP); Shinichiro Matsumoto, Kanagawa-ken (JP); Tsutomu Araki, Kanagawa-ken (JP); Toshiyuki Hiraoka, Kanagawa-ken (JP); Yoshiyuki Matsunaga, Kanagawa-ken (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 0 days.

(21) Appl. No.: 10/284,348

(22) Filed: Oct. 31, 2002

(65) Prior Publication Data

US 2003/0080691 A1 May 1, 2003

(30) Foreign Application Priority Data

Oct. 31, 2001 (JP) ..... P2001-335662
Dec. 27, 2001 (JP) ..... P2001-397205
Mar. 29, 2002 (JP) ..... P2002-097684

(51) Int. Cl.[7] ..... H01J 1/02
(52) U.S. Cl. ..... 313/46; 313/318.01; 313/11
(58) Field of Search ..... 313/318.01–318.12, 313/11, 46, 27, 624, 634, 42, 484

(56) References Cited

U.S. PATENT DOCUMENTS 4,444,944 A * 4/1984 Matsushita ..... 524/786
4,739,222 A * 4/1988 Nomoto et al. ..... 315/57
5,164,635 A * 11/1992 De Jong et al. ..... 315/58
5,691,598 A * 11/1997 Belle et al. ..... 313/493

FOREIGN PATENT DOCUMENTS

| | | | | |
|---|---|---|---|---|
| JP | 57-50762 | | 3/1982 | |
| JP | 59004539 | Y2 * | 2/1984 | ..... H01J/61/52 |
| JP | 2002203425 | A * | 7/2002 | ..... F21V/23/02 |
| WO | WO 9613048 | A1 * | 5/1996 | ..... H01J/7/24 |

* cited by examiner

*Primary Examiner*—Nimeshkumar D. Patel
*Assistant Examiner*—German Colón
(74) *Attorney, Agent, or Firm*—Pillsbury Winthrop LLP

(57) ABSTRACT

A compact selfballasted fluorescent lamp includes a fluorescent arc tube forming a crooked discharge path, a housing comprised of a first end portion open to be fit thereon with a bulb-base, a middle portion and a second end portion open to be mounted thereto with the fluorescent arc tube, a lighting circuit module accommodated in the housing, the unit being provided with a circuit board and two or more circuit components mounted on the circuit board for constituting a lighting circuit for lighting the fluorescent arc tube, and a thermal conductor having a thermal conductivity of 0.1 W/(m·K) or more, which is filled in the housing, extending upwards from a components mounting side of the circuit board of the lighting circuit module and contacting with the inner wall of the housing lying on the side of the first end portion of the housing, thereby covering at least one of the circuit components of the lighting circuit.

14 Claims, 10 Drawing Sheets

COMPACT SELFBALLASTED FLUORESCENT LAMP AND LUMINAIRE

CROSS-REFERENCE TO RELATED APPLICATIONS

This application is based upon and claims the benefit of priority from the prior Japanese Patent Applications JP2001-335662 filed on Oct. 31, 2001, JP2001-397205 filed on Dec. 27, 2001 and JP2002-97684 filed on Mar. 29, 2002, the entire contents of which are incorporated herein by reference.

FIELD OF THE INVENTION

The present invention relates to a compact selfballasted fluorescent lamp and a luminaire.

BACKGROUND OF THE INVENTION

A compact selfballasted fluorescent lamp is composed of one integrated fluorescent arc tube whose discharge path is formed by crooked tubes and a housing for supporting the fluorescent arc tube. The housing has a bulb-base and accommodates a lighting circuit module for lighting the fluorescent arc tube.

In such a compact selfballasted fluorescent lamp, there is a great concern that the temperature rise within the housing during lighting causes a bad influence on the circuit components of the lighting circuit. In order to prevent the temperature rise within the housing caused by the heat of the lighting circuit module, it is known as a technique of filling synthetic resin in the space between the circuit board and the housing so as to contact them with each other, as disclosed in, e.g., the JP-A 57-50762.

In the conventional technique, synthetic resin is filled in the space between the circuit board and the inner wall of the housing, contacts the circuit components mounted on the circuit board and the inner wall of the housing. Thus heat of the lighting circuit module utilizing the electronic ballast is dissipated by conducting through the synthetic resin. Hereby, while the lighting efficiency of the fluorescent arc tube being improved, the temperature rise in the lighting circuit module could be depressed. Further, it is not necessary to define an air hole in a housing and to use an expensive glove having high heat resistance either.

However, as the compact selfballasted fluorescent lamp is high-powered and miniaturized the space for accommodating the luminaire becomes much more narrow. As a result, the temperature within the housing rises further. In case of an inverter circuit, wherein the lighting circuit mounted in a compact selfballasted fluorescent lamp is composed of circuit components, some circuit components relatively vulnerable to heat are included in them. Thus, it is necessary to prevent overheating inside the housing by more efficiently dissipating heat in the housing in order to protect the circuit components. Furthermore, the practical specification of the synthetic resin for dissipating heat inside the housing has to be adopted in consideration of the heat resistance of the circuit board or circuit components. However, neither detailed analyses nor sufficient developments for making heat inside the housing not to defect the lighting circuit module have been proceeded.

SUMMARY OF THE INVENTION

The present invention has an object to provide a compact selfballasted fluorescent lamp which has a high reliability in the lighting circuit module by efficiently dissipating heat inside the housing, in consideration of dissolving the problems as described above.

A compact selfballasted fluorescent lamp according to the first aspect of the invention, comprising a fluorescent arc tube forming a crooked discharge path, a housing comprised of a first end portion open to be fit thereon with a bulb-base (hereinafter referred to as bulb-base applying end portion), a middle portion and a second end portion open to be mounted thereto with the fluorescent arc tube (hereinafter referred to as fluorescent arc tube module applied portion), a lighting circuit module accommodated in the housing, the unit being provided with a circuit board and two or more circuit components mounted on the circuit board for constituting a lighting circuit for lighting the fluorescent arc tube, and a thermal conductor having a thermal conductivity of 0.1 W/(m·K) or more, which is filled in the housing, extending upwards from a components mounting side of the circuit board of the lighting circuit module and contacting with the inner wall of the housing lying on the side of the first end portion of the housing, thereby covering at least one of the circuit components of the lighting circuit.

The thermal conductor is desirable to have heat conductivity higher than air, and have moderate fluidity at the time of filling the thermal conductor in the housing.

In order to efficiently dissipate heat of the lighting circuit module developed by itself or conducted from the fluorescent arc tube, the thermal conductor filled in the housing in proximity to the circuit components developing a large amount of heat or contacted with a part of or whole surface of the circuit component, and also it is desired to contact with the housing inner wall as large an area as possible.

The circuit components subject to the heat dissipation by the thermal conductor may be not only those developing a large amount of heat but also those having low heat resistance. That is, it is because the thermal conductor has a function to prevent heat affection on the circuit components having low heat conductor.

A housing for accommodating the lighting circuit module for lighting the fluorescent arc tube is made of synthetic resin or a metal with thickness of 0.5 to 3 mm in general.

An area surrounding the circuit components of the lighting circuit module inside the housing is relatively large. Accordingly, the thermal conductor is able to contact with the housing inner wall over relatively large area, so that it is able to conduct and dissipate heat developed inside the housing to the outside.

In order to conduct heat from the circuit components to the housing efficiency, it needs to enhance the thermal conductivity of the thermal conductor. It was experimentally confirmed that it was able to efficiently lower the temperature inside the housing when the thermal conductor has a thermal conductivity more than 0.1 W/(m·K). As the thermal conductor having such thermal conductivity, for example, silicone resin or epoxy resin are suitable.

In case of an integrated crooked fluorescent arc tube, its cooked portions may have a semicircle shape or a horseshoe shape. Alternatively, adjacent two straight tubes of parallel-aligned two crooked tubes may be coupled through a coupling tube communicating with their sides near the respective tube ends in order to form a crooked discharge path.

In the compact selfballasted fluorescent lamp according to the first aspect of the invention, at least one of the circuit components mounted on the circuit board of the lighting circuit module is covered with the thermal conductor whose thermal conductivity is more than 0.1 W/(m·K), while the thermal conductor contacts with the inner wall of the housing, thereby it is able to efficiently dissipate heat developed by the circuit components via the thermal conductor.

A compact selfballasted fluorescent lamp according to the second aspect of the invention, comprising a fluorescent arc tube forming a crooked discharge path, a housing having a bulb-base applying end portion, a middle portion and a second end portion open to be mounted thereto with the fluorescent arc tube, a lighting circuit module accommodated in the housing, the unit being provided with a circuit board and two or more circuit components mounted on the circuit board for constituting a lighting circuit for lighting the fluorescent arc tube, and a thermal conductor filled in the housing in contacting with the inner wall of the housing, thereby covering some circuit components of the lighting circuit module, wherein the housing excepting the bulb-base applying end portion has an outer surface area per unit lamp power not exceeding 500 $mm^2/W$.

The term "bulb-base fitting portion of the housing" means a cylindrical portion formed on one end of the housing, whereon the bulb-base is to be fit.

When the housing excepting the bulb-base applying end portion has an outer surface area per unit lamp power more than 500 $mm^2/W$, it suffers affections of heat developed by the lighting circuit module itself and the fluorescent arc tube. However, in such a conventional compact selfballasted fluorescent lamp wherein a whole surface are of the housing is large, the heat spreads within the housing, while it is dissipated from the housing with a very large surface. Thus, the temperature in the housing is less apt to rise so high to deteriorate the lighting circuit module. Therefore, it would not be required to fill the thermal conductor in the housing for efficiently dissipating heat inside the housing differently from such a conventional technique.

In the compact selfballasted fluorescent lamp according to the second aspect of the invention, even though the compact selfballasted fluorescent lamp is miniaturized but high-powered so as that the housing excepting the bulb-base fitting portion has an outer surface area per unit lamp power not exceeding 500 $mm^2/W$, the lighting circuit module is less deteriorated from the heat affection since the thermal conductor filled in the housing which covers at least one of the circuit components of the lighting circuit module and contacts the inner wall of the housing efficiently dissipates heat developed by the lighting circuit module and the fluorescent arc tube.

In addition to the feature of the second aspect of the invention, in the compact selfballasted fluorescent lamp according to the third aspect of the invention, the thermal conductor contacts the inner wall of the housing more than 30% thereof.

When the area that the thermal conductor contacts with the housing inner wall is not more than 30% of the inner wall of the housing, it is difficult to sufficiently dissipate heat, and the amount of heat conducted from the fluorescent arc tube exceeds the amount of heat developed by the lighting circuit module, so that the temperature in the housing rises even though the thermal conductor is filled in the housing. In order to provide a lighting circuit module with a high reliability by restraining occurrences of failures in the lighting circuit module by the heat affections, it is necessary make the contacting area to 30% or more of the inner wall of the housing.

According to the third aspect of the invention, the compact selfballasted fluorescent lamp is able to reliably dissipate heat in the housing through the thermal conductor and the housing.

In addition to the feature of any one of the first to third aspects of the invention, the compact selfballasted fluorescent lamp according to the fourth aspect of the invention is characterized by that the thermal conductor of the compact selfballasted fluorescent lamp is curable and has a viscosity of 10 to 500 Pa·s in being filled in the housing.

It is desirable for manufacturing the compact selfballasted fluorescent lamp that the thermal conductor is filled in the housing after that the lighting circuit module has been accommodated in the housing. In this case, in order to fill up the thermal conductor in narrow gaps between the circuit components arranged densely and the housing inner wall, the thermal conductor is desired to have a moderate fluidity capable of flowing into the narrow gaps at the time of filling.

In order to satisfy such a condition, it was experimentally confirmed that the viscosity of the thermal conductor should be not exceeding 500 Pa·s in being filled in the housing. Furthermore, the thermal conductor flows out of the gap formed between the circuit board and the fluorescent arc tube holder before it is cured if the viscosity of the thermal conductor is low. So, it was experimentally confirmed that the flowing of the thermal conductor could be prevented if the thermal conductor has the viscosity more than 10 Pa·s.

The viscosity of the thermal conductor is defined in the Japanese Industrial Standards JIS-K 6300.

In the compact selfballasted fluorescent lamp according to the fourth aspect of the invention, it is able to fill up the thermal conductor in the space between the circuit components and the housing inner wall without leaving any gap, and also it is able to prevent the thermal conductor from flowing out of the gap between the circuit board and the fluorescent arc tube holder.

In addition to the feature of any one of the first to fourth aspects of the invention, the compact selfballasted fluorescent lamp according to the fifth aspect of the invention is characterized by that the hardness of the thermal conductor of the compact selfballasted fluorescent lamp is not more than 100 JIS-A after cured.

The cured thermal conductor after filled in the housing expands by heat developed by the fluorescent arc tube and the lighting circuit module while lighting, and then it presses the circuit components, circuit board, and housing. Thus, it was found that the thermal stress causes the problem such as a crack. So, it was experimentally found that it is able to prevent the thermal stress of the expanded thermal conductor to the circuit components, circuit board, and housing by setting the hardness of the thermal conductor after cured not more than a predetermined value.

The hardness of the thermal conductor is defined in the Japanese Industrial Standards JIS-K 6253.

In the compact selfballasted fluorescent lamp according to the fifth aspect of the invention, since the hardness of the thermal conductor after cured is not more than 100 JIS-A, the thermal stress of the thermal conductor applied to the circuit components is lessen in spite of the thermal expansion of the thermal conductor, so as not to cause the problem to the circuit components.

In addition to the feature of any one of the first to fifth aspects of the invention, the compact selfballasted fluorescent lamp according to the sixth aspect of the invention is characterized by that the thermal conductor contains a filler more than 0.1% by mass, which is made of at least one of oxide, nitrogen oxide, and oxide hydrogen of one element among a group consisting of aluminum (Al), silicon (Si), titanium (Ti), and magnesium (Mg).

As an additive for enhancing the thermal conductivity of the thermal conductor, for instance, there are oxides such as $Al_2O_3$, $TiO_2$, $SiO_2$, MgO, nitrides such as AlN, $Si_3N_4$, and hydrates such as $Al_2O_3$-$nH_2O$, $TiO_2$-$nH_2O$, $Mg(OH)_2$.

In the compact selfballasted fluorescent lamp according to sixth aspect of the invention, an amount of heat developed by the fluorescent arc tube increases with a miniaturization of the fluorescent arc tube, and the temperature in the housing accommodating the lighting circuit module increases as the miniaturization of the housing. However, by adding more than 0.1% by mass of fillers made of at least one of oxide, nitrogen oxide, and oxide hydrogen of one element among a group which consists of aluminum (Al), silicon (Si), titanium (Ti), and magnesium (Mg) to the thermal conductor which is filled in the housing, the thermal conductivity of the thermal conductor in the housing heated to high temperatures will be better, so that it is able to efficiently dissipate heat from the circuit components and the fluorescent arc tube and also able to control to prevent the heat affection to the lighting circuit.

In addition to the feature of any one of the first to sixth aspects of the invention, the compact selfballasted fluorescent lamp according to the fifth aspect of the invention is characterized by that the thermal conductor contains oligomers not more than D10 in the total content not exceeding 5000 ppm.

The term "constituents not more than D10" means those of monomers which stay in not combined completely. When these constituents are used as the thermal conductor, these are easily emitted as impurity gas from silicone resin which becomes high temperature during the operation. When the total content of the oligomer constituents not more than D10 that are monomers staying in being not combined completely is more than 5000 ppm, the impurity gas is generated more, and constituents gasified during the lamp operation adhere to a glass glove, so that the light transmitting efficiency of the fluorescent arc tube is deteriorated. When the total content of the oligomer constituents not more than D10 is not exceeding 5000 ppm, although constituents with less amount of monomers are easily gasified, the light transmitting efficiency of the fluorescent arc tube is not deteriorated since the oligomer constituents which adhere to the glass glove are not much. Accordingly, the total content of the oligomer constituent should not exceed 5000 ppm. It is desirable to have less oligomer constituents, since the less it contains the oligomer constituents, the less gases are generated during the lighting operation. However, the less it contains the oligomer constituents, the more the thermal conductor will be expensive, so that it is desirable to contain the oligomer constituent not more than D10 in the thermal conductor will be about 2000 ppm.

In the compact selfballasted fluorescent lamp according to the seventh aspect of the invention, by specifying the monomer and a total content of the oligomer constituent of the thermal conductor which is filled in the housing heated to high temperature, it is able to control the amount of gas generated from the oligomer constituents of the thermal conductor.

In addition to the feature of any one of the first to seventh aspects of the invention, the compact selfballasted fluorescent lamp according to the eighth aspect of the invention is characterized by that the thermal conductor is filled in the housing so as to contact with at least a metal portion of the bulb-base.

Since at least a node of the bulb-base is made of a metal, the thermal conductivity is relatively high. Therefore, it is able to dissipate heat effectively by conducting heat in the housing via the thermal conductor which put to the metal part of the bulb-base.

In the compact selfballasted fluorescent lamp according to the eighth aspect of the invention, in addition to an effect of any one of the first to the seventh aspects of the invention, since at least the node of the bulb-base is made of a metal which has high thermal conductivity, the radiating effect is further heightened by conducting heat from the thermal conductor to the bulb-base.

In addition to the feature of any one of the first to eighth aspects of the invention, the compact selfballasted fluorescent lamp according to the ninth aspect of the invention is characterized by that a fine tube enclosing an amalgam is mounted on the tube end of the compact selfballasted fluorescent lamp, and that the thermal conductor is able to contact with the fine tube by being filled through through-holes defined in the circuit board.

The through-hole defined in the circuit board, that is a hole through which a fine tube is penetrable from the back of the board, is desirable to be formed a little bigger than a fine tube outer diameter.

The term "fine tube and the thermal conductor contact each other" means that the end of the fine tube may contact with the circuit board surface, or it may penetrate through the hole in the circuit board to the bulb-base side. In short, the thermal conductor and the fine tube may contact each other.

In the compact selfballasted fluorescent lamp according to ninth aspect of the invention, in case of that the thermal conductor and the fine tube contact each other, since heat from the circuit components is conducted to the fine tube via the thermal conductor, the amalgam is wormed quickly, and the mercury evaporates at an early stage right after lighting operation, so that the luminous flux start-up characteristic can be improved.

A compact selfballasted fluorescent lamp according to the tenth aspect of the invention, comprising a fluorescent arc tube forming a crooked discharge path, a housing comprised of a first end portion open to be fit thereon with a bulb-base, a middle portion and a second end portion open to be mounted thereto with the fluorescent, a light circuit module provided with two ore more circuit components including an electrolytic capacitor which constitutes a light circuit for lighting the fluorescent arc tube on and a circuit board to which these circuit components are mounted, and is accommodated in a housing, and a thermal conductor which is filled in the housing so as to contact with the inner wall of the housing above the upper side of the circuit board of the lighting circuit module, thereby covering the circuit components of the lighting circuit modules excepting at least a safety valve of an electrolytic capacitor.

The term "portion excepting a safety valve of an electrolytic capacitor" means a portion of the electrolytic capacitor shaped in approximately cylindrical excepting its bulb-base side, which indicates a housing for covering impregnated element and a sealing portion for sealing the housing formed on the fluorescent arc tube side, and which may also contain lead wires lead out of the sealing portion.

Like a conventional technique wherein all the circuit components mounted on the bulb-base side among the circuit components mounted on the circuit board are covered by synthetic resin material, in case of keeping lighting the lamp at high temperature to the extent that the temperature in the housing exceeds a rated acceptable temperature or in a housing of being applied a voltage at the life last stage when inner electrolysis liquid vaporizes and decreases, the electrolytic capacitor tends to open the safety valve. However, if the safety valve of the electrolytic capacitor is completely covered by synthetic resin, the safety valve will not be opened, so that the electrolytic capacitor would explode. Therefore, the thermal conductor is needed to cover a portion excepting the safety valve of the electrolytic capacitor.

In the compact selfballasted fluorescent lamp according to the tenth aspect of the invention, since the thermal conductor covers a portion excepting a safety valve of the electrolysis capacitor, the safety valve is able to be opened in case of that the lamp is kept lighted at high temperature that exceeds the rated acceptable temperature of the electrolysis capacitor or at the life last stage when the electrolysis liquid of the electrolysis capacitor decreases, thereby it is able to prevent a risk such as a burst.

In addition to the feature of any one of the first to tenth aspects of the invention, the compact selfballasted fluorescent lamp according to the eleventh aspect of the invention is characterized by that the fluorescent arc tube holder mounted on the second end portion of the housing is made of synthetic resin containing at least flame retardant.

Although synthetic resin containing flame retardant also contains a bromine compound to enhance the flame retardance, it generates gases of halogen such as bromine in response to the heat and the ultraviolet rays from the fluorescent arc tube. When the halogen gases encroach on an inside the lighting circuit module through the gap between the circuit board and the rubber packing as a sealing metal of the circuit board, it will corrode the electrolytic capacitor and causes problems. Therefore, it is desirable not to use synthetic resin containing flame retardant for a compact selfballasted fluorescent, which is lighted at a high temperature as much as possible. However, such synthetic resin which does not contain aflame retardant is expensive, so that it will make the compact selfballasted fluorescent lamp expensive. In the present invention, a rubber packing portion as a sealing material is covered completely by the thermal conductor in order to seal the gap between the fluorescent arc tube holder and the circuit board, thereby it is able to prevent the invasion of halogen gases into the lighting circuit module.

In the compact selfballasted fluorescent lamp according to the eleventh aspect of the invention, in addition to the operations according to the first to the tenth aspects of the invention, it is able to provide an inexpensive compact selfballasted fluorescent lamp by using synthetic resin containing flame retardant.

In addition to the feature of any one of the first to eleventh aspects of the invention, the compact selfballasted fluorescent lamp according to the twelfth aspect of the invention is characterized by that all tube ends of the compact selfballasted fluorescent lamp are placed so as to face the circuit board.

Although in such a conventional compact selfballasted fluorescent lamp, one integrated crooked tube is accommodated in a glove, positions or configurations of the tube ends are not practically specified. Furthermore, in previous well-known techniques, a fluorescent arc tube was not thinned to the extent that the tube-wall load rises, and the miniaturization of whole body was not advanced, so that it did not get so high temperature as to cause problems to the lighting circuit module by the heat of the fluorescent arc tube.

In the compact selfballasted fluorescent lamp according to the twelfth aspect of the invention, since all tube ends of the fluorescent arc tube are placed so as to face the circuit board, the lighting circuit module which is placed in proximity to the tube ends supporting electrodes thereon tend to be affected by the heat, however, it is able to prevent from getting high temperature inside the housing by dissipating heat via the thermal conductor filled in the housing.

A luminaire according to the thirteenth aspect of the invention is characterized by that it is comprised of the compact selfballasted fluorescent lamp according to any one of the first to the twelfth aspects of the invention and a luminaire main body to which the compact selfballasted fluorescent lamp is mounted.

In the luminaire according to the thirteenth aspect of the invention, it is able to provide a luminaire which is provided with a compact selfballasted fluorescent lamp having a function of any one of the first to the twelfth aspect of the invention.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Referring now to the attached drawings, FIGS. 1 to 10, some embodiments suitable to the present invention will be explained hereinafter.

Figure 1:
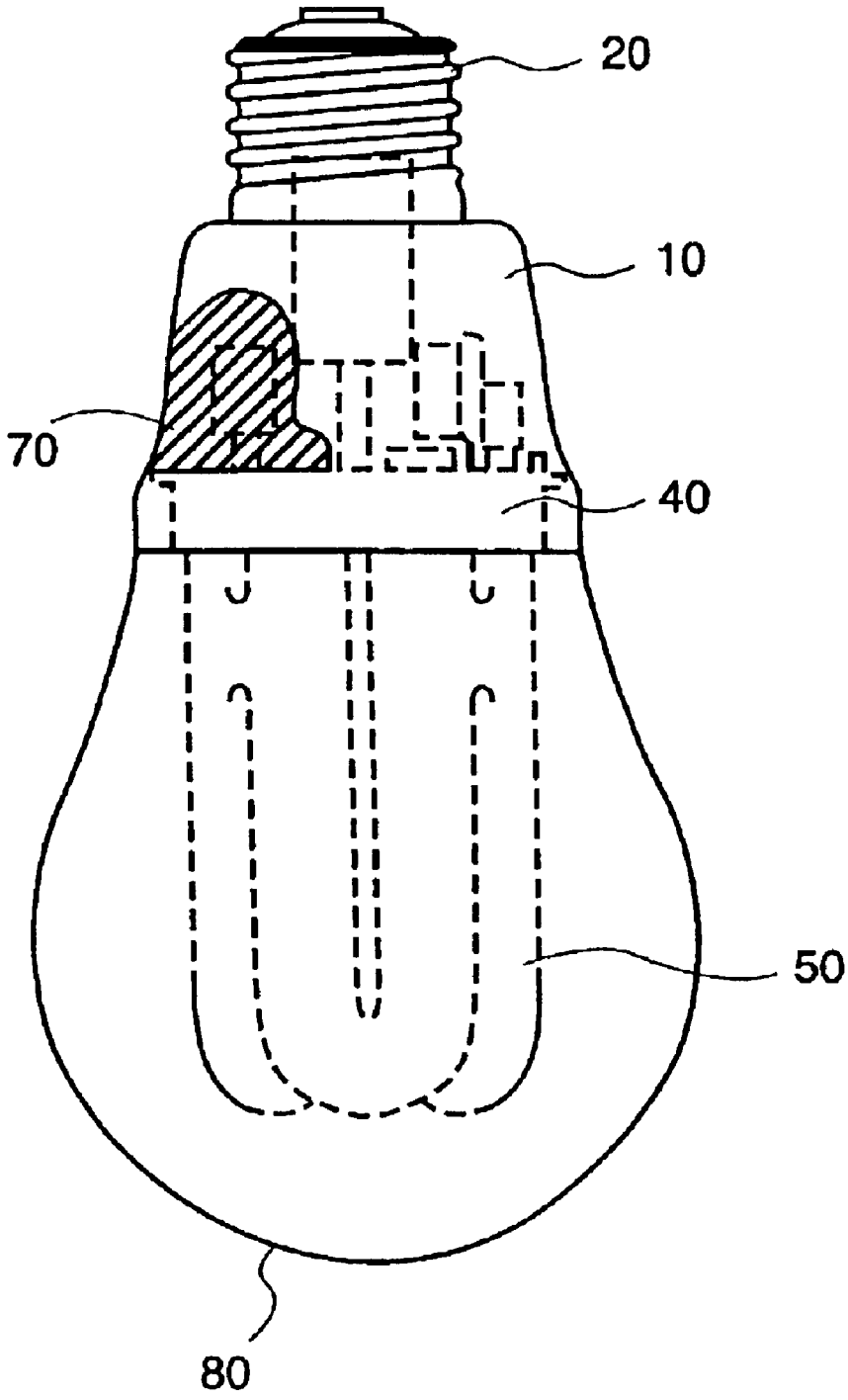
FIG. 1 is a partial perspective diagram showing the first embodiment of the compact selfballasted fluorescent lamp according to the present invention.
Figure 2:
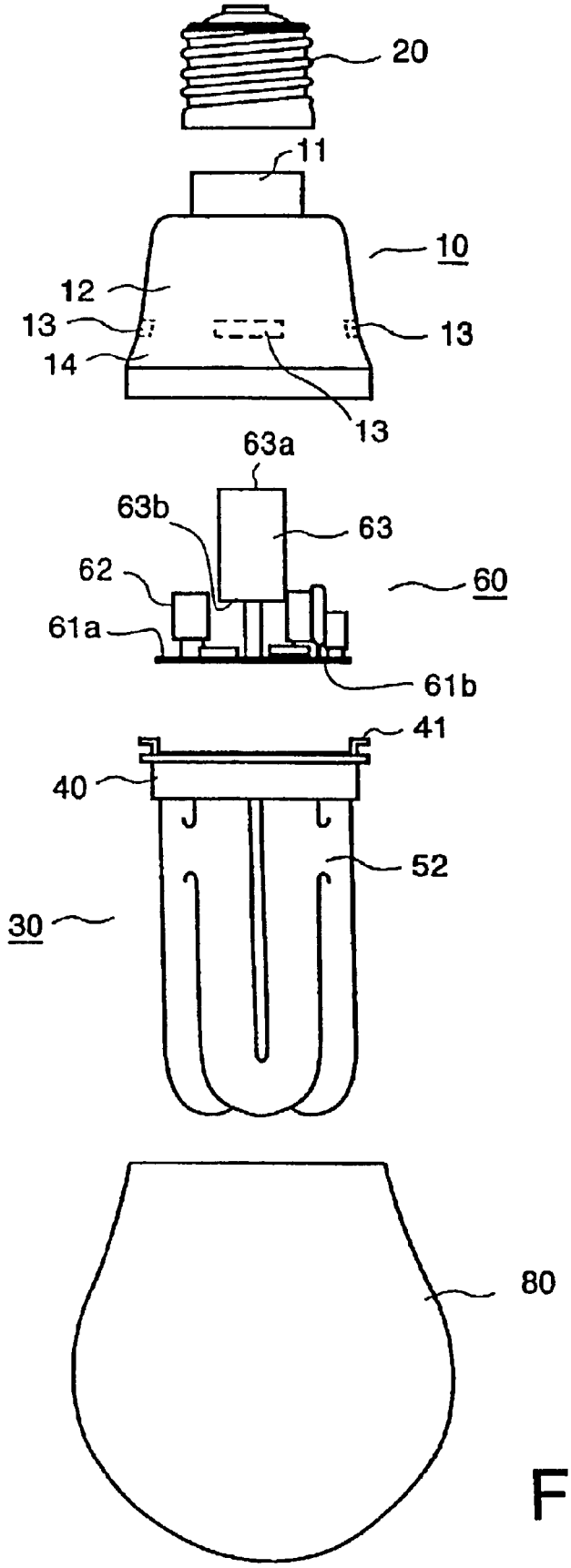
FIG. 2 is an exploded view of the compact selfballasted fluorescent lamp shown in FIG. 1.

FIG. 1 is a side view of the first embodiment of the compact selfballasted fluorescent lamp. FIG. 2 is an exploded view of the compact selfballasted fluorescent lamp shown in FIG. 1.

A housing 10 of the compact selfballasted fluorescent lamp is made of heat-resistant synthetic resin such as polybutylene terephthalate (PBT). A bulb-base 20 fits on a cylindrical portion (hereinafter referred to as bulb-base fitting portion) 11 forming the first end portion of the housing 10. A cup-like portion 12 forming a middle portion of the housing 10 gradually spreads downwards. A fluorescent arc tube module mounting portion 14 forming the second end portion of the housing 10 is next to the mostly spreading end of the cup-like portion 12. Then, the housing has an outer surface area of about 5300 $mm^2$. The fluorescent arc tube module mounting portion 14 is defined two or more engaging depressions 13 along its circular inner wall. Hereinafter, it is assumed that the bulb-base fitting portion 11 takes the upper position while the fluorescent arc tube module mounting portion 14 takes the lower position due to the convenience of the discussion.

A fluorescent arc tube module 30, which is mounted on the fluorescent arc tube module mounting portion 14 in the lower side of the housing 10 is comprised of a disk-shaped holder 40 made of a heat resistant synthetic resin such as a PBT resin and a fluorescent arc tube 50 whose tube ends are fixed to the holder 40. Two or more through-holes (not shown) for receiving the tube ends of the fluorescent arc tube 50 are formed on the holder 40. Furthermore, a cylindrical frame is formed on the rim of the holder 40. Furthermore, two or more engaging hooks 41 capable of engaging with the engaging depressions 13 formed on the inner wall of the fluorescent arc tube module mounting portion 14 are formed in extending from the upper end of the cylindrical frame.

The fluorescent arc tube 50 is composed of three U-shaped tubes 51 coupled together. Each U-shaped tube 51 is made of a glass tube of circular section whose outside diameter is about 8 to 13 mm. In this embodiment, its outer diameter is about 11 mm, and its inner diameter is about 9.5 mm. Each of the U-shaped tubes 51 curves smoothly around its center, and then two straight portions extend in parallel from the ends of the curved portion. Then, these three U-shaped tubes 51 are arranged so that three planes each intersecting the two straight portions of each U-shaped tubes 51 constitute three sides of an equilateral triangle. A phosphor film is provided on the inner wall of each U-shaped tube 51, and mercury and rare gas, e.g., argon are filled in the fluorescent arc tube 50. These three U-shaped tubes 51 are coupled by two coupling tubes 52. Then, one integrated crooked discharge path having a length about 280 mm is formed. A pair of electrodes 54 are disposed at the both ends of the fluorescent arc tube 50, i.e., the both ends of the discharge path.

The respective tube ends of the U-shaped tube 51 of the fluorescent arc tube 50 are inserted into the through-holes defined in the holder 40, and fixed thereto by silicone resin, etc. Hereby, a fluorescent arc tube module 30, wherein the fluorescent arc tube 50 is held by the holder 40, is constituted.

A lighting circuit module 60 is accommodated in the housing 10 in a state that the lighting circuit module 60 faces the holder 40 of the fluorescent arc tube module 30. The lighting circuit module 60 is provided with a disk-shaped circuit board 61 which faces the holder 40 of the fluorescent arc tube module 30 in parallel. On an upper side of the circuit board 61, i.e., a components mounting side 61*a* of the circuit board 61, which faces the inner wall of the housing 10, two or more circuit components 62 are mounted, wherein an electronic lighting circuit for lighting a fluorescent arc tube 50 at a high frequency region such as an inverter circuit is constituted. Since lead wires of most of these circuit components 62 mounted on the components mounting side 61*a* of the circuit board 61 are inserted through the through-hole in the circuit board 61 and soldered to a printed-circuit side 61*b* at the bottom of the circuit board 61. Furthermore, in order to avoid the problem of electric connection failures caused by thermal stresses applied to the circuit components 62 by the thermal expansion of the cured silicone resin 70, it is desirable that the silicone resin 70 has moderate flexibility or elasticity after the silicone resin 70 had been cured. An electrolytic capacitor 63 or a film capacitor with relatively vulnerable heat-resistance is included in these circuit components 62. The electrolytic capacitor 63 is mounted on the circuit board 61 in vertically position, and partially resides in the bulb-base fitting portion 11 of the upper part of the housing 10. Furthermore, on the printed-circuit side 61*b*, i.e., the back of the circuit board 61, a chip-like parts having package thickness 2 to 3 mm with relatively high heat resistance such as a rectifier, a diode bridge chip, a transistor, or a resistor are mounted.

A lighting circuit module 60 is attached to the holder 40 by inserting the circuit board 61 across the engaging hooks 41 on the side opposite to the fluorescent arc tube non-mounting side.

The silicone resin 70 as a thermal conductor is filled in the housing so that it covers the circuit components 62 mounted on the lighting circuit module 60.

Two electric power supply wires (not shown in figure) led from the circuit board 61 are wired in a gap between the electrolytic capacitor 63 and the bulb-base fitting portion 11 and coupled to the bulb-base 20.

As an example of the silicone resin 70 having the thermal conductivity, the viscosity before cured, and the hardness after cured as specified in this embodiment, "CMA-431 A & B" etc available from Kabushiki-Kaisha Shin-Etsu Kagaku is quoted. The "CMA-431 A & B" has a viscosity before cured of 50 to 75 Pas, and a hardness after cured of 27 to 37 JIS-A, and including oligomers not more than D10 in 1280 ppm in the silicone resin 70.

Now, the process of assembling the compact selfballasted fluorescent lamp of the present embodiment will be explained.

First, the holder 40 on which the fluorescent arc tube 50 and the lighting circuit module 60 are attached is inserted into the housing 10 from the opening, so that the engaging depressions 13 of the housing 10 lower inner wall and the engaging hook 41 formed on the holder 40 are fixed. Then, a silicone resin 70 having a good thermal conductivity and fluidity is poured into the housing 10 through the opening of the bulb-base fitting portion 11 lying upside the cylindrical portion 11, thereby covering the circuit components 62 mounted on the circuit board 61 sufficiently. At that time, the silicone resin 70 also contacts the inner wall of the housing 10. Since an electrolytic capacitor 63 is considerably large in size, the silicone resin 70 may be poured in the housing through the gap between the inner wall of the bulb-base fitting portion 11 and the electrolytic capacitor 63 accommodated in the cylindrical portion 11 using nozzle. Otherwise, the electrolytic capacitor 63 may be placed in the housing 10 after that the silicone resin 70 had been poured in the housing 10 and covered the other circuit components 62 previously mounted on the circuit board 61 in the housing 10. Here, the way of pouring the silicone resin 70 is not limited, as long as the silicone resin 70 can be reliably contacted with both the circuit components 62 and the inner wall of the housing 10.

Thus, by pouring the silicone resin 70 from the bulb-base fitting portion 11 above the housing 10, it is able to reliably fill the silicone resin 70 in the housing 10. Furthermore, since the silicone resin 70 is poured from the top of the housing 10, the silicone resin 70 flows down toward the circuit board surface 61 through between the circuit components 62 by its own weight, so as to improve the operating efficiency.

Then, the lighting circuit module 60 and the bulb-base 20 are electrically coupled by two electric power supply wires (not shown in figure), and the bulb-base 20 is fit on the bulb-base fitting portion 11 of the housing 10 and then fixed thereto by caulking. The compact selfballasted fluorescent lamp constructed as mentioned above obtains a light flux of about 810 lm with rated lamp power 13W by using a three-band emission fluorescent substance for a phosphor film.

Finally, a glove 80 is mounted on the fluorescent arc tube module mounting portion 14 at the bottom of the housing 10 and fixed there with adhesives such as silicone resin.

Here, in the compact selfballasted fluorescent lamp of the present embodiment the fluorescent arc tube 50 is covered by the glove 80, however, the glove 80 is not necessarily required for the compact selfballasted fluorescent lamp.

According to the construction mentioned above, when the power of the lighting circuit module 60 of the compact selfballasted fluorescent lamp is turned on, a starting voltage is applied to across a pair of electrodes 54 of the fluorescent arc tube 50, and the fluorescent arc tube 50 starts discharging to light the compact selfballasted fluorescent lamp.

Since each circuit component of the lighting circuit module 60 generates heat and the heat generated by the fluorescent bulb is conducted to the lighting circuit module 60 during the lighting operation of the compact selfballasted fluorescent lamp, the temperature of the circuit component 62 rises. However, the heat is efficiently conducted to the housing 10 via the thermal conductor 70 and then dissipated.

Figure 3:
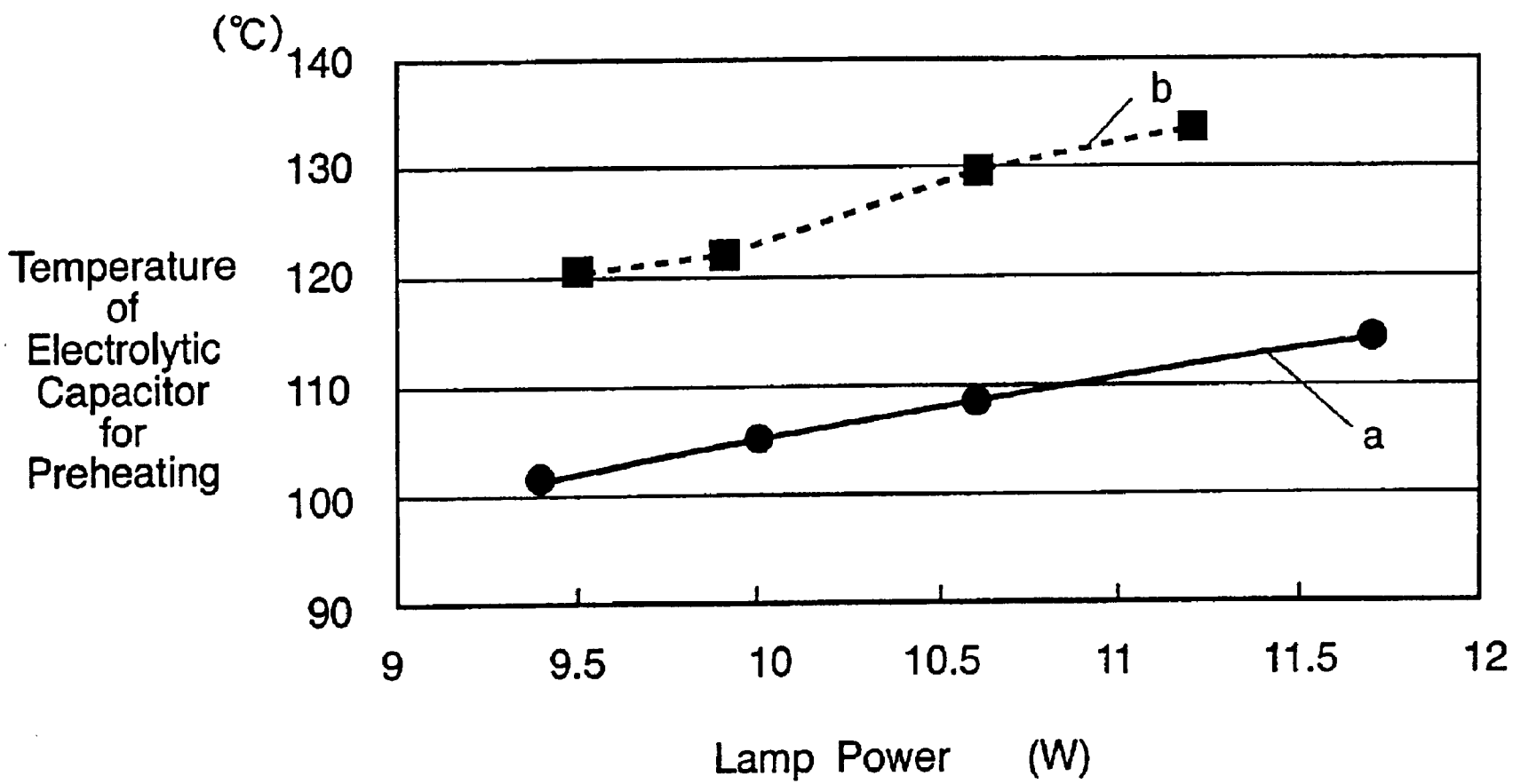
FIG. 3 is a graph showing the differences of the lamp power temperature characteristic of the electrolytic capacitors by the existence of a thermal conductor.

FIG. 3 is a graph showing temperature of an electrolytic capacitor for preheating 63 which is coupled in parallel with the fluorescent arc tube 50, that are measured by lighting a compact selfballasted fluorescent lamp in which a silicone resin 70 is filled in the housing 10 (a), and one in which a silicone resin 70 is not filled up (b) with different lamp power. A lamp a and lamp b are identical excepting the existence of the silicone resin 70. The lamp power is changed by adjusting the applied voltage.

As is evident from the graph shown in FIG. 3, in the compact selfballasted fluorescent lamp wherein a silicone resin 70 is filled in the housing 10, the temperature of the housing 10 and the circuit components 62 covered by the silicone resin 70, for instance, the temperature of the electrolytic capacitor for preheating 63 coupled in parallel with the fluorescent bulb here is decreased in comparison with a conventional compact selfballasted fluorescent lamp b wherein a silicone resin 70 is not filled up.

Hereby, it is able to provide a reliable lighting circuit module 60 by reliably protecting the circuit components 62 from overheat. Hereby, it is able to provide an excellent compact selfballasted fluorescent lamp by improving its operating life.

Figure 4:
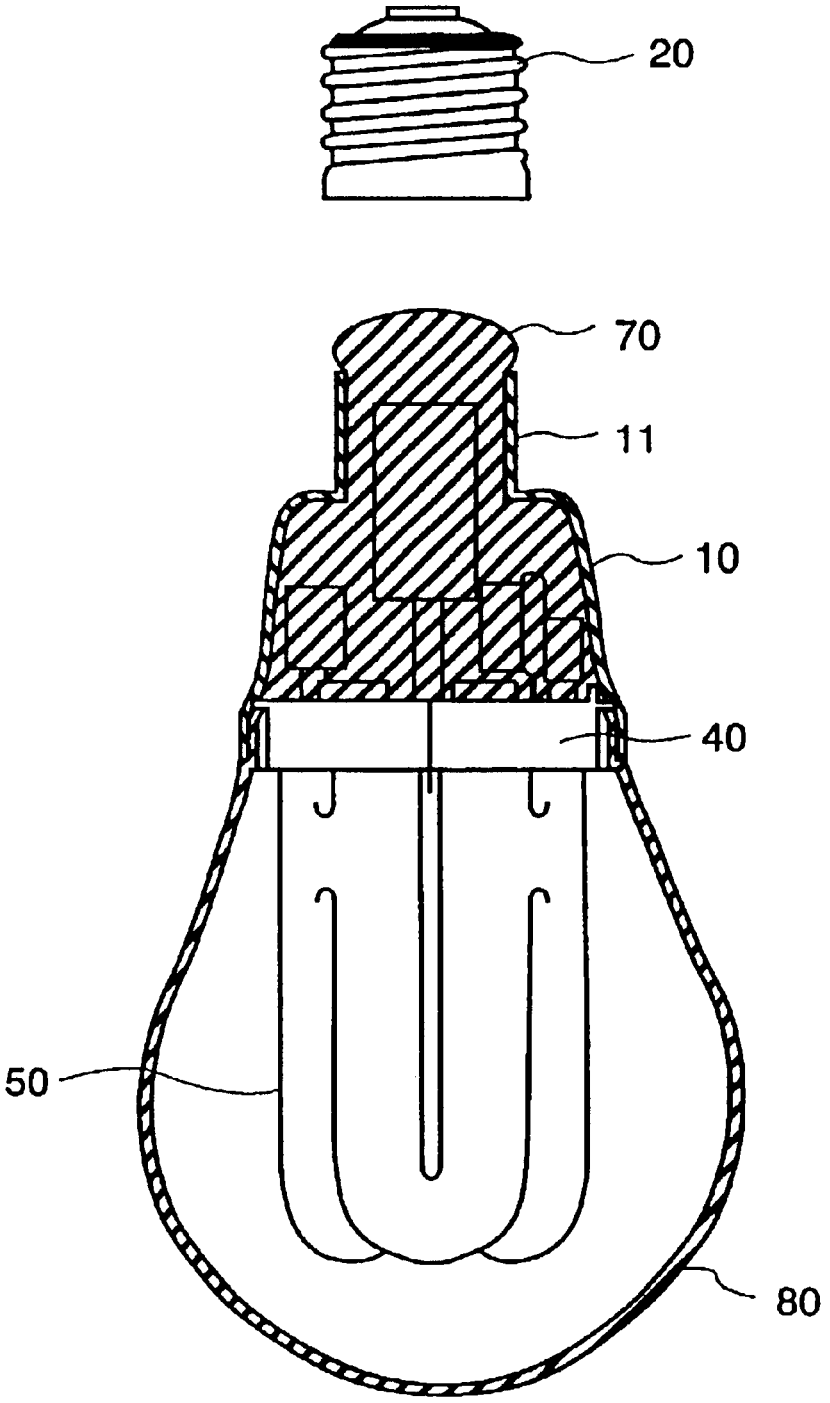
FIG. 4 is a sectional view showing the second embodiment of the compact selfballasted fluorescent lamp according to the present invention.

Referring now to FIG. 4, a second embodiment of the present will be explained hereinafter.

FIG. 4 is a sectional view of the second embodiment, showing the state where the bulb-base 20 is separated from the rest of the lamp body.

Here, the compact selfballasted fluorescent lamp according to the present embodiment is the same as that of the first embodiment excepting that the silicone resin 70 is filled up in the housing 10.

First, the lighting circuit module 60 constituted in the same way as that of the first embodiment is accommodated in the housing 10, and the fluorescent arc tube module 30 is fixed to the housing 10 by that engaging hooks 41 formed on the holder 40 of the fluorescent arc tube module 30 are engaged to the engaging concave 13 formed portions formed on the inner wall of the fluorescent arc tube module mounting portion 14. Then, a silicone resin 70 having a good thermal conductivity and fluidity is poured into the housing 10 through the opening of the bulb-base fitting portion 11 of the housing 10 lying upside the cylindrical portion 11, so as to be filled up around the circuit components 62 mounted on the circuit board 61. At the time of pouring the silicone resin 70 in the housing, an electrolytic capacitor 63 which is of considerably large size is accommodated in the bulb-base fitting portion 11. Thus, it may be poured by inserting a silicone resin 70 filling nozzle in a gap between the inner wall of the cylindrical portion 11 and the electrolytic capacitor 63, or it may be poured into the lighting circuit module 60 and cover the circuit components 62 before accommodated in the housing 10.

Here, in the present embodiment, since the silicone resin 70 is filled up within the housing 10 over whole, all circuit components 62 are covered by the silicone resin 70, as a result, they will be thermally coupled with the housing 10. Further, since the silicone resin 70 having fluidity rises with its surface tension when it is filled up to the upper end of the bulb-base fitting portion 11 of the housing 10, it could contact to the bulb-base 20, which is fit on the bulb-base fitting portion 11 under such a condition. Accordingly, since the heat inside the housing 10 is dissipated via the housing 10 and the metal bulb-base 20 which has high heat dissipation operation, the heat dissipation of the of the compact selfballasted fluorescent lamp will be much more effective with a large heat dissipation area.

Since the silicone resin 70 contacts with almost whole the components mounting side 61*a*, i.e., the upper side of the circuit board when a switching element such as FET is mounted on the printed-circuit side 61*b*, the heat developed by the circuit component mounted on the printed-circuit side 61*b* is transmitted to the silicone resin 70 via the circuit board 61, so that the heat is dissipated effectively in the same.

Then, a circumference edge at the bottom inner wall of the housing 10 and a glove 80 opening circumference edge are fixed with adhesives such as a silicone resin.

Here, in the compact selfballasted fluorescent lamp according to the present embodiment, the fluorescent arc tube 50 is covered by the glove 80, however, the glove 80 is not necessarily required for the compact selfballasted fluorescent lamp.

According to the construction mentioned above, when the power of the lighting circuit module 60 of the compact selfballasted fluorescent lamp is turned on, a starting voltage is applied to across a pair of electrodes 54 of the fluorescent arc tube 50, and the fluorescent arc tube 50 starts discharging to light the compact selfballasted fluorescent lamp.

Accordingly, the lighting circuit module 60 and the fluorescent arc tube 50 develop heat during lighting the compact selfballasted fluorescent lamp, and the circuit components of the lighting circuit in the housing is heated. However, by filling up the silicone resin 70 to the first end portion of the housing 10, it is able to transmit and dissipate heat of the circuit components to the housing 10 and the bulb-base 20 effectively, so as to improve the reliability of the lighting circuit module 60.

Figure 5:
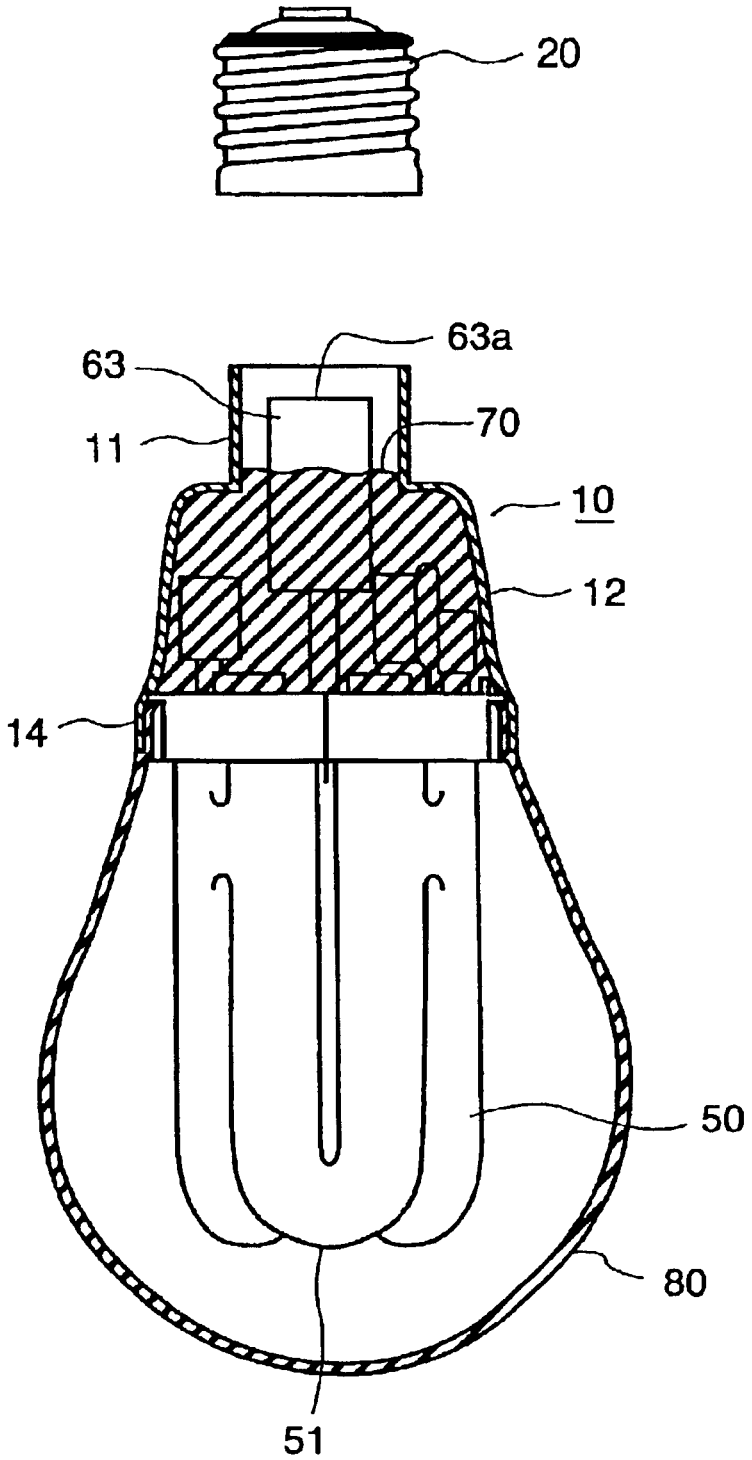
FIG. 5 is a sectional view showing the third embodiment of the compact selfballasted fluorescent lamp according to the present invention.

Referring now to FIG. 5, a third embodiment of the compact selfballasted fluorescent lamp according to the present invention will be explained hereinafter.

Here, in the third embodiment of the present invention, the silicone resin 70 is filled in the housing to the extent that it does not close the safety valve 63*a* of the electrolytic capacitor 63, while it shields the space between the housing 10 inner wall and the circuit board 61 so that warm air heated in by the fluorescent arc tube 50 not to flow in the housing 10. Here, the holder 40 is made of the synthetic resin containing flame retardant. Other configurations are the same as those of the first and the second embodiments.

That is, the holder 40 of the fluorescent arc tube module 30 is comprised of, e.g., brominated polycarbonate, PBT and $Sb_2O_3$, which are synthetic resins containing flame retardant.

After combining the lighting circuit module 60 to the holder 40, the fluorescent arc tube module 30 is fixed to the fluorescent arc tube module mounting portion 14 at the lower portion of the housing 10, so that the lighting circuit module 60 is accommodated in the housing 10. Then, a silicone resin 70 is poured in the housing 10 from the opening of the bulb-base fitting portion 11 of the housing 10 lying upside the cylindrical portion 11. When the silicone resin 70 is poured in the housing 10, a silicone resin 70 filling nozzle is inserted in a space between the bulb-base fitting portion 11 inner wall and the electrolytic capacitor 63 so that the silicone resin 70 is not poured on the safety valve 63*a* mounted on the components mounting side of the electrolytic capacitor 63 in the bulb-base fitting portion 11, but the silicone resin 70 is filled up to the first end portion of a cup-like portion 12 of the electrolytic capacitor 63 from the components mounting side 61*a* of the circuit board 61 at the bottom end of the housing 10.

By filling up the silicone resin 70 almost inside the cup-like portion 12 of the housing 10, all circuit components 62 mounted on the circuit board 61 are filled in the silicone resin 70 excepting the electrolytic capacitor 63, whose head exposes out of the silicone resin 70. Here, the gap between the lower portion of the housing 10 and the circuit board 61 is sealed by the silicone resin 70.

Then, a glove 80 for covering the fluorescent arc tube 50 is mounted on the lower end of the housing 10 and fixed there with adhesives such as a silicone resin. Then, the bulb-base 20 is fit on the bulb-base fitting portion 11 of the housing 10 and then fixed thereto by caulking, thereby the assembling of the compact selfballasted fluorescent lamp is completed.

Since the compact selfballasted fluorescent lamp constructed as mentioned above performs lighting of the required lamp output after being miniaturized, the fluorescent arc tube 50 reaches high temperature during lighting. In order that the holder 40 has a flame retardance, which is able to bear the high temperature, a bromine compound added to the synthetic resin decomposes in response to the high temperature heat and ultraviolet rays of the fluorescent arc tube 50, so as to generate bromine gases such as bromophenol. However, since the circuit components 62 inside the housing 10 is isolated from the holder 40 by the circuit board 61, and they are also filled in the silicone resin 70, in addition, the bottom surface sealing portion 63*b* of the electrolytic capacitor 63 is covered by the silicone resin 70, they are blocked off from the bromine gases generated form the holder 40, and not receive any bad effect such as corrosion by the bromine gases.

Here, in the compact selfballasted fluorescent lamp of the present embodiment the fluorescent arc tube 50 is covered by the glove 80, however, the glove 80 is not necessarily required for the compact selfballasted fluorescent lamp.

When the power is turned on in the compact selfballasted fluorescent lamp mentioned above, a starting voltage is applied across a pair of electrodes 54 of the fluorescent arc tube 50 from the lighting circuit module 60, and the fluorescent arc tube 50 starts discharging to light the compact selfballasted fluorescent lamp.

Thus, even though the holder 40 is made of the synthetic resin containing flame retardant, the circuit components of the lighting circuit do not receive any bad effect such as corrosion by the bromine gases since they are blocked off by a silicone resin 70 from the bromine gases generated from the synthetic resin containing flame retardant. Further, by filling up the silicone resin 70 in almost entire of the housing 10, heat of the housing 10 and the bulb-base 20 is dissipated through the silicone resin 70, and the circuit components 62 of the lighting circuit are prevented from overheating, so as to improve the reliability of the lighting circuit module 60.

Figure 6:
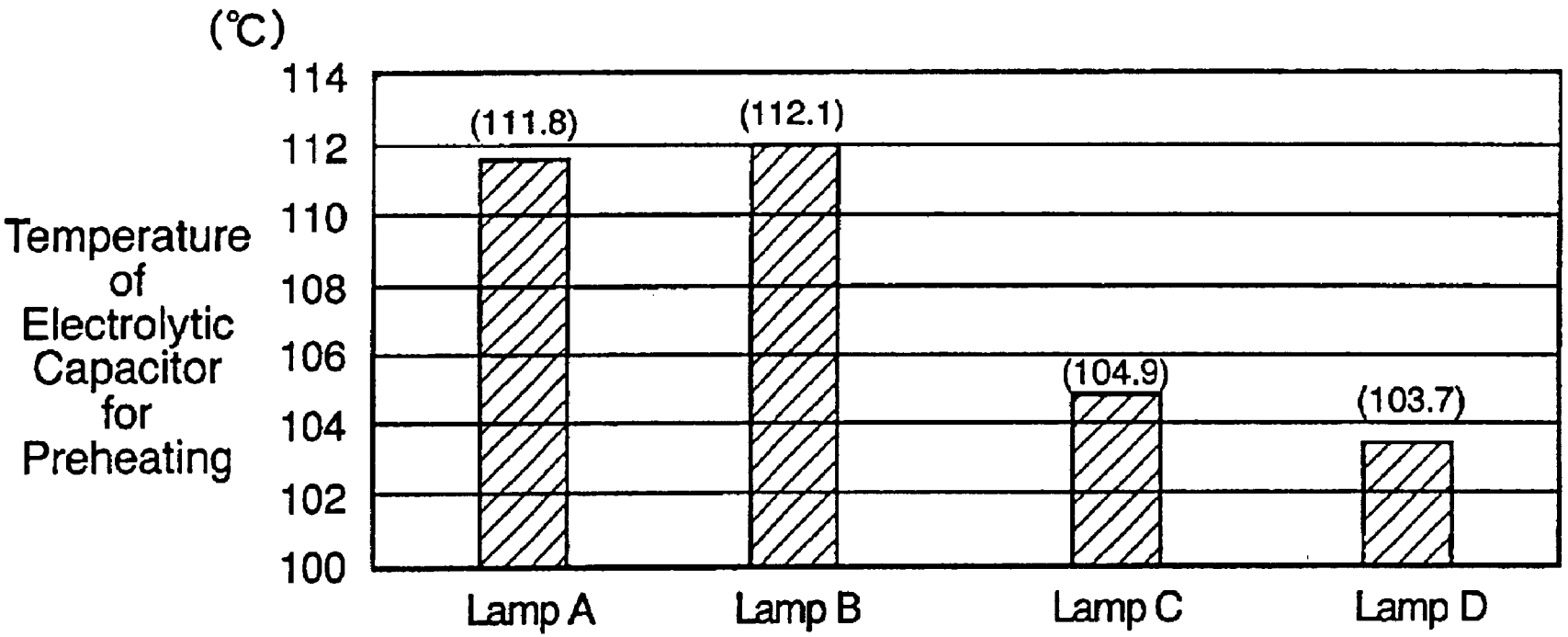
FIG. 6 is a graph showing the amount of the thermal conductor and the temperature of the circuit components.

FIG. 6 is a graph comparatively showing temperatures of the electrolytic capacitor 63 among the circuit components in a conventional compact selfballasted fluorescent lamp (conventional lamp A) where no silicone resin is employed, another conventional compact selfballasted fluorescent lamp (conventional lamp B) wherein a silicone resin is filled up in a gap between the holder 40 of the fluorescent arc tube module 30 and the circuit board 61 of the lighting circuit module 60 without leaving any space, a compact selfballasted fluorescent lamp according to the present invention (the third embodiment C) wherein a silicone resin 70 is filled in the housing up to the bottom end of the bulb-base fitting portion 11 thereby the upper half of the electrolytic capacitor 63*a* exposes from the silicone resin 70, and another compact selfballasted fluorescent lamp according to the present invention (the fourth embodiment D) wherein a silicone resin 70 is filled up in the housing up to a height capable of contacting the innermost portion of the bulb-base 20 fit on the bulb-base fitting portion 11. Those compact selfballasted fluorescent lamps A to D are identical excepting the existence of the silicone resin 70, and the temperature of the electrolytic capacitor 63 is measured by lighting them with the same lamp power 10 W.

As is evident from the graph shown in FIG. 6, when comparing the compact selfballasted fluorescent lamp A wherein the silicone resin 70 is not filled up and the compact selfballasted fluorescent lamp B wherein the silicone resin 70 is filled up between the holder 40 of the fluorescent arc tube module 30 and the circuit board 61 of the lighting circuit module 60, the temperature of the electrolytic capacitor 63 is higher in the lamp B than that in the lamp A. This means that when the silicone resin 70 is filled up between the fluorescent arc tube module 30 and the lighting circuit module 60 heat from the fluorescent arc tube 50 is conducted to the lighting circuit module 60, thereby the temperature inside the housing rises on the contrary.

In the third embodiment C wherein the silicone resin 70 is filled up to the bottom end of the bulb-base fitting portion 11, the temperature of the electrolytic capacitor 63 decreases significantly compared with the conventional lamps A and B. Moreover, in the fourth embodiment D wherein the silicone resin 70 is filled up in the housing 10 from the disk surface of the holder 40, that is, up to the top end of the bulb-base fitting portion 11, the temperature of the electrolytic capacitor 63 decreases furthermore compared with the third embodiment C, however, the difference is not so much remarkable.

This means that by filling up the silicone resin 70 in the housing 10 from the components mounting side of the circuit board 61 of the lighting circuit module 61 accommodated in the housing 10 up to reach a height where a substantial part of the circuit components 62 is buried in the silicone resin 70 the temperature of the circuit component 62 is deteriorated remarkably, thereby the reliability of the lighting circuit module 70 is improved. Hereby, it is able to provide an excellent compact selfballasted fluorescent lamp which has a long life.

Figure 7:
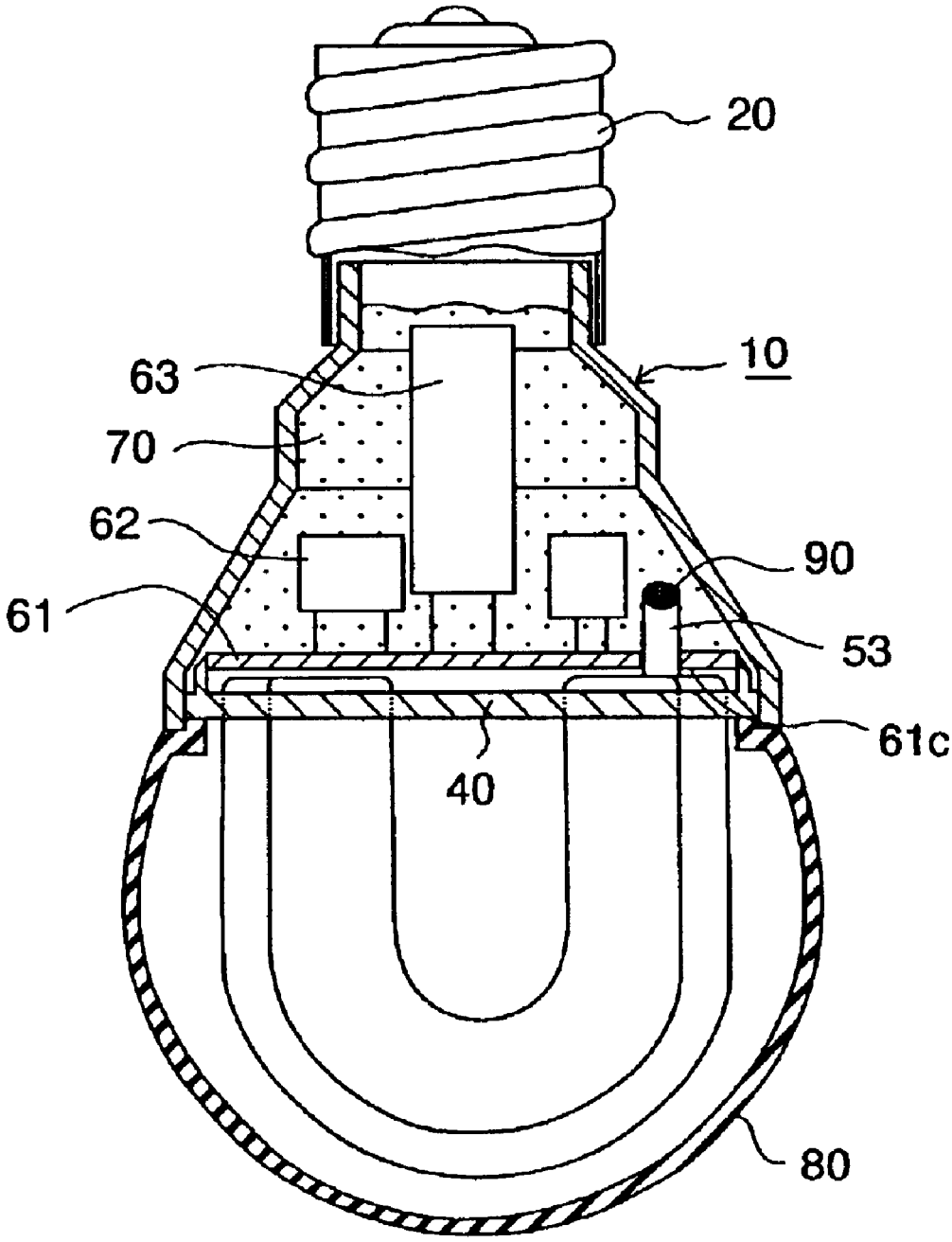
FIG. 7 is a sectional view showing the fourth embodiment of the compact selfballasted fluorescent lamp according to the present invention.
Figure 8:
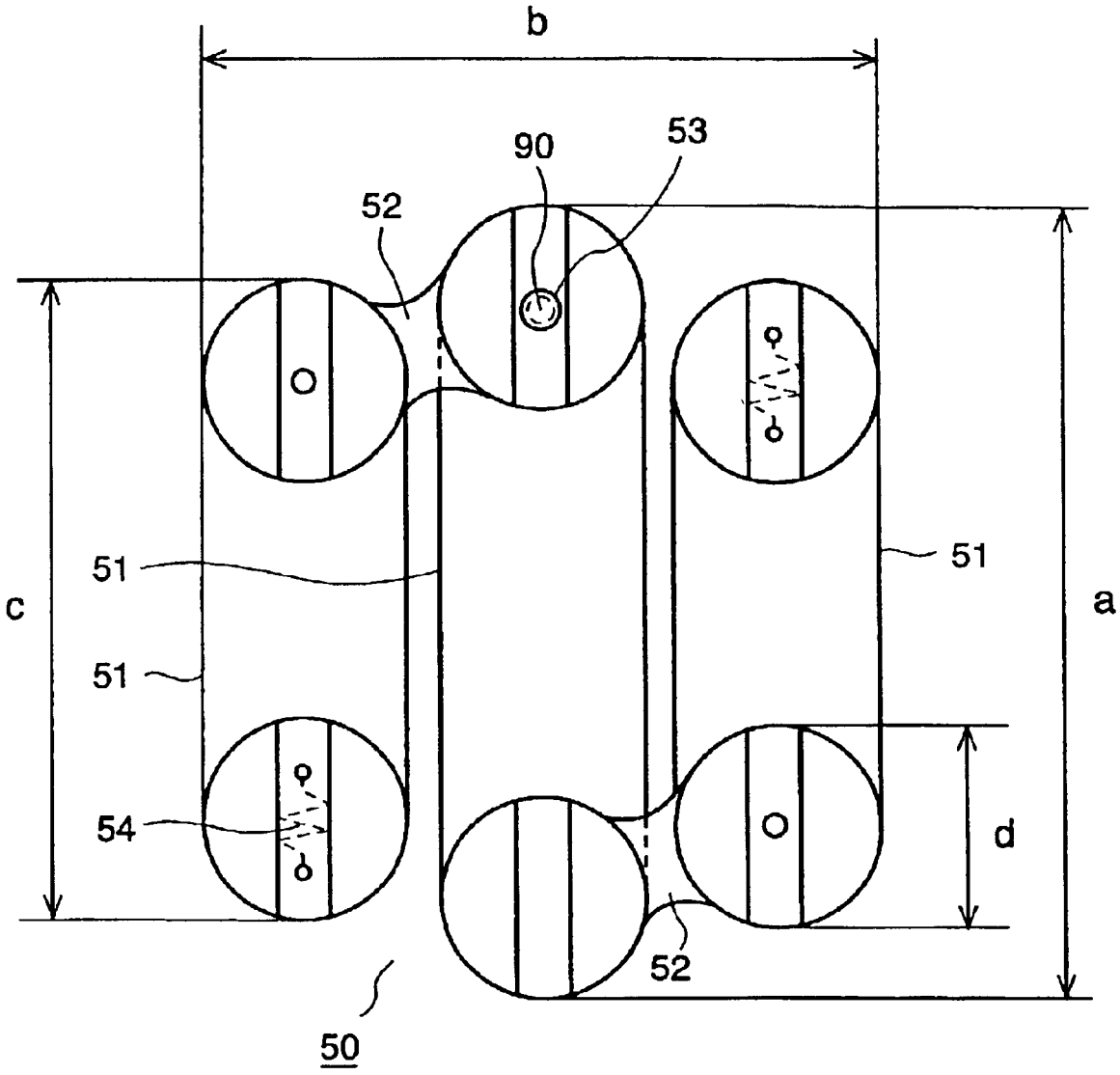
FIG. 8 is a plan view of the fluorescent arc tube shown in FIG. 7.
Figure 9:
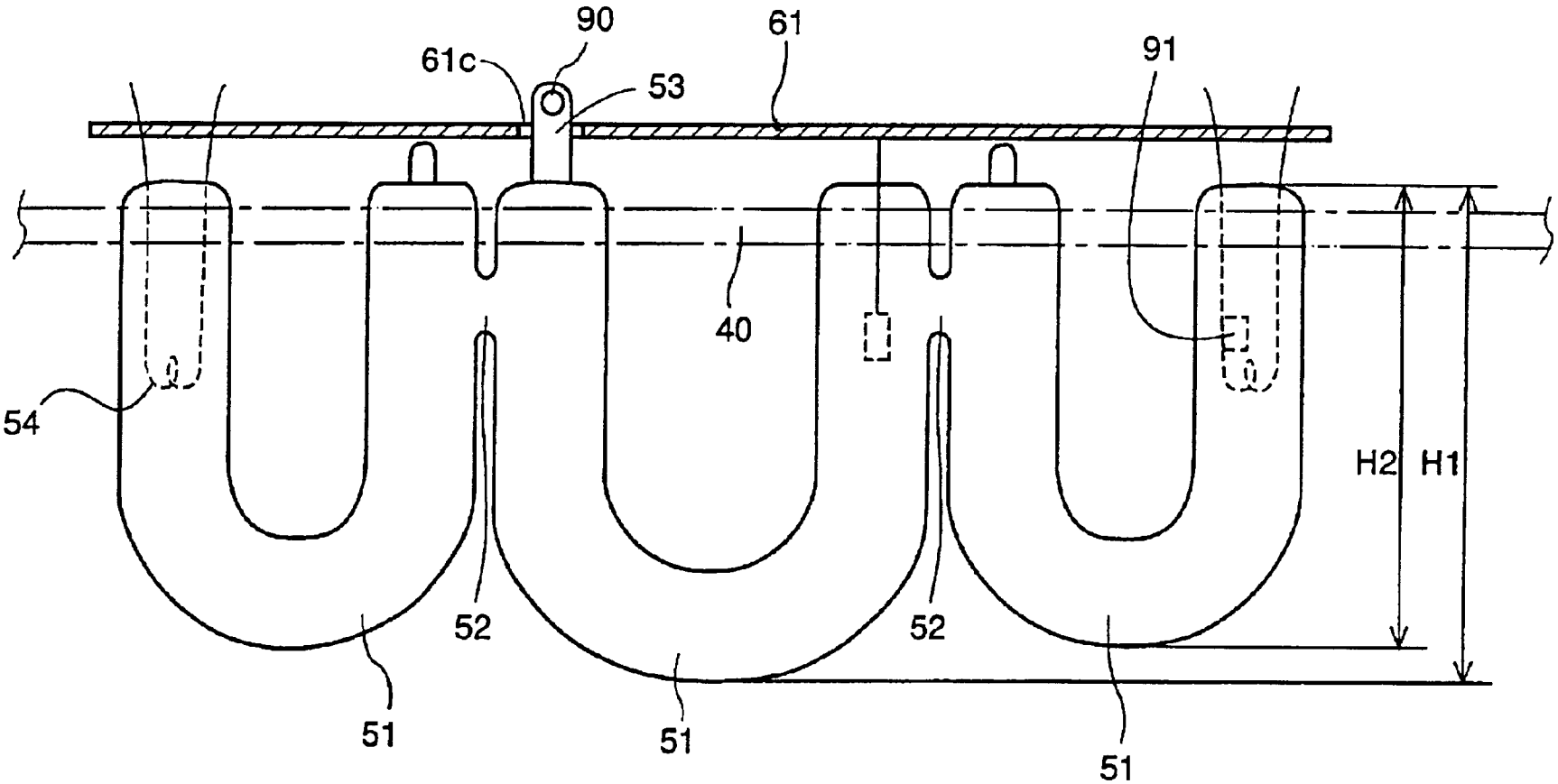
FIG. 9 is an expansion view of the fluorescent arc tube and the circuit board shown in FIG. 7.

Referring now to FIGS. 7 to 9, a fourth embodiment of the present invention will be explained hereinafter. FIG. 7 is a sectional view showing the compact selfballasted fluorescent lamp according to the fourth embodiment of the present invention, FIG. 8 is a plan view of the fluorescent arc tube shown in FIG. 7, and FIG. 9 is an expansion view of the fluorescent arc tube shown in FIG. 7.

The compact selfballasted fluorescent lamp is provided with an outer enclosure which is comprised of a housing 10, a bulb-base 20, and a glove 80, a fluorescent arc tube 50 which is attached to a holder 40 and then accommodated in the outer enclosure, and a lighting circuit module 60.

The compact selfballasted fluorescent lamp is shaped in a height of 75 to 105 mm from the bulb-base 20 to the glove 80 and 34 to 45 mm in diameter of the glove portion having the maximum diameter, in order to be accommodated in almost the same profile as that of the miniaturized incandescent lamp, e.g., the mini-krypton type incandescent lamp.

The housing is made of a heat-resistant synthetic resin such as polybutylene terephthalate (PBT), an Edison E17 type bulb-base 20 is fit on the cylindrical portion of the housing 10 and then fixed thereto by adhessive bonding or caulking, its cup-like portion 12 extends to the opposite direction to the bulb-base fitting portion 11 in the taper-shape, and a fluorescent arc tube module mounting portion 14 is formed at its extended end of the cup-like portion.

The fluorescent arc tube 50 has three-U-shaped tubes 51, and these bulbs 51 are coupled by two coupling tubes 52 so that that the planes of the U-shaped tubes 51 extending through those straight tube portions faces each other, then the electrodes 54 are placed at the base ends of the straight portion of the U-shaped tubes 51 which are placed at the opposite both ends.

Each U-shaped tube 51 is made of a glass tube of circular section whose outside diameter is about 5 to 10 mm. In this embodiment, its outer diameter is about 8.0 mm, and its inner diameter is about 6.5 mm. Each of the straight tube portions of the U-shaped tubes 51 placed on both sides which do not have the electrode is coupled to next the straight tube portion of the U-shaped tube 51 placed at the central with a coupling tube 52. Each U-shaped tube is about 35 to 40 mm high. Here, the height H1 of the central U-shaped tube 51 and the height H2 of the U-shaped tubes 51 of both sides have the relation of H1>H2. Here, the term "height" of the U-shaped tube means the distance between the base end of the straight tube to the top of the U-shaped portion of the U-shaped tube.

As a result, the fluorescent arc tube 50 whose U-shaped tubes 51 are coupled with the coupling tubes 52 will form a 120 to 200 mm long discharge path. Each coupling tube 52 is formed over the through-hole which is opened on a specific portion near the tube end of the straight tube of the U-shaped tube 51 by melting with heat.

The fluorescent arc tube 50 is closed by pinch sealing, that is the basic portion of the straight portion of the U-shaped tube 51 is softened by heat and then pinched out.

Further, fine tube 53 called exhaust tubes are protruded from the tube ends of the U-shaped tubes 51 on both sides which are not mounted with electrode 54 and one tube end of the central U-shaped tube 51 in communication with each U-shaped tube. Some fine tubes 53 are sealed beforehand by melting in the process of assembling the U-shaped tubes 51, thereby an air inside the U-shaped tubes 51 is exhausted through other fine tubes, and enclosure gases are enclosed there, then the U-shaped tubes are sealed.

The fine tube 53 of the central U-shaped tube 51 is closed after enclosing main amalgam 90 in it. This main amalgam 90, which is an alloy made of mercury, bismuth, and indium in a shape of a sphere, is uses to control the mercury vapor pressure in the U-shaped tubes 51 in a proper range. Here, as an amalgam 90, a mercury alloy such of a tin and a lead may be used in addition to that of bismuth and indium. Furthermore, in each U-shaped tube 51 at the both end an auxiliary amalgam 91 having the same mercury vapor pressure as that of the main amalgam 90 is enclosed by supported by the wells of the electrode 54. Furthermore, in a straight portion of the central U-shaped tube 51 at the basic portion where a fine tube 53 is not mounted on, an auxiliary amalgam 91 is enclosed by supported by a support wire.

Then, after the tube end portion of the straight tube of each U-shaped tube 51 is inserted in the through-hole defined in the holder 40, adhesives such as a silicone resin are applied to the other side of the holder 40, thereby the fluorescent arc tube 50 is fixed on the holder 40.

The lighting circuit 60 is comprised of a disc-like circuit board 61 placed on the lower portion of the housing 10 and two or more circuit components 62 mounted on either upper side or both upper and lower sides of the circuit board 61, whereon the an inverter circuit for lighting fluorescent arc tube 50 at a high frequency region, that is a high frequency lighting circuit is constituted.

When the circuit component 62 is mounted on the both upper and lower sides of the circuit board 61, a circuit component 62 which is relatively vulnerable to heat such as a film capacitor or a large-sized circuit component such as an electrolytic capacitor 63 are arranged on a top side 61*a* of the circuit board 61 which faces the inside of the housing 10, on the other hand, a tip-shaped circuit component 62 such as REC of a rectifier or a diode bridge, a transistor, or resistance which is relatively strong against heat and small height is arranged on the bottom side where the printing wiring is wired which faces the holder 40 of the fluorescent arc tube module 30.

The fine tube 53 enclosing a main amalgam 90 of the fluorescent arc tube 50 is inserted in the through-hole 61*c* of the circuit board 61, and a switching element such a field effect transistor (FET) is arranged on the components side 61*a* of the circuit board 61 near the through-hole 61*c*. That is, since the main amalgam 90 in the fine tube 53 and the switching element of the lighting circuit module 60 are arranged close to each other, the main amalgam 90 is warmed quickly and evaporates by the heat of the switching element which generates heat relatively fast among the circuit components 62 at the starting time of the compact selfballasted fluorescent lamp, then the mercury vapor pressure in the fluorescent arc tube 50 rises also quickly, so that it is able to improve the lighting start-up characteristic.

As shown in FIG. 8, the in a fluorescent arc tube 50, the width "a" of the central U-shaped tube 51 is 30 to 35 mm. When the depth of the fluorescent arc tube 50 along the parallel direction of the U-shaped tube 51 is denoted as b, and the width of the U-shaped tube 51 at the both side is denoted as c, they are related as follows.

$$0.9a \geqq b \geqq 0.75a$$

$$0.9a \geqq c \geqq 0.75a$$

As an example which satisfies above equations, for instance, the width "a" of the central U-shaped tube 51 is about 32 mm, the width "c" of the U-shaped tubes 51 at the both sides is about 26 mm, and the depth "b" of the fluorescent arc tube 50 is about 26 mm. In this case, the height of the central U-shaped tube 51 is 37 mm, and that of the U-shaped tubes 51 at the both ends is 34 mm.

When the depth "b" of the fluorescent arc tube 50 exceeds 0.9a, the width of the fluorescent arc tube 50 in its diagonal direction is widened excessively, thus, it is not suitable for a miniaturization. When the width b is 0.75a or less, light on a radial plane of the fluorescent arc tube is distributed unevenly excessively, thus it is not desirable. When the width "c" of the U-shaped tubes 51 at the both sides exceeds 0.9a, the width of the fluorescent arc tube 50 in its diagonal direction is widened excessively, thus, it is not suitable for a miniaturization. When the width "c" is 0.75 or less, the length of the discharge path of the fluorescent arc tube 50 is excessively shortened, thereby the lamp efficiency is deteriorated.

When the width b of the fluorescent arc tube 50 is within a range mentioned above, since each U-shaped tube 51 is arranged close to each other, the width "c" of the U-shaped tubes 51 at the both sides is able to be elongated. Accordingly, since the U-shaped tubes 51 at the both sides are located at subcentral of the glove 80, while the discharge path of the fluorescent arc tube 50 is elongated, the height of the U-shaped tubes 51 at both sides is heightened. As a result, the discharge path of the fluorescent arc tube 50 is able to be elongated moreover. Therefore, it is able to secure the required length of the discharge path of the fluorescent arc tube and improve the lighting efficiency within a restricted size to accommodate the fluorescent arc tube in a miniaturized incandescent lamp size glove.

According to the fourth embodiment of the present invention, the height H1 of the central U-shaped tube 51 of the fluorescent arc tube 50 is 35 to 40 mm, and the height H2 of the U-shaped tubes 51 at both sides is 35 to 40 mm, (here, H1>H2), and the length of the discharge path is 120 to 200 mm. When the fluorescent arc tube having the profile as described above is lighted with the lamp power 7 to 12 W, it is able to obtain a total luminous flux more than 450 lm and a lamp efficiency more than 45 lm/W. The compact selfballasted fluorescent lamp using the fluorescent arc tube 50 mentioned above is able to emit light with the same optical output as that of a miniaturized incandescent lamp having almost the same profile as that of the compact selfballasted fluorescent lamp.

It is experimentally confirmed that the length of the discharge path is required to be more than 120 mm to obtain the same optical output as that of a miniaturized incandescent lamp. That is, when the length of the discharge path is 120 mm or less, it does not emit light, a ratio of the length of the electrode portion which does not emit light and thus fails to contribute to the discharge path length occupying in the entire length of the fluorescent arc tube 50 increases. Thus, the desirable lamp efficiency and optical output are not obtained. Therefore, the length of the discharge path is required to be more than 120 mm. On the other hand, when the length of the discharge path exceeds 200 mm, the lamp starting voltage rises extremely, and it is difficult to generate such a high starting voltage in the lighting circuit module which is miniaturized to be accommodated in almost the same profile as that of the miniaturized incandescent lamp. Thus, the length of the discharge path is suitable to be in a range from 120 to 200 mm.

In order to accommodate the U-shaped tubes 51 in almost the same profile as that of the miniaturized incandescent lamp, the maximum width of the fluorescent arc tube 50 is set not more than 45 mm, more preferably, not more than 40 mm, and the height of it is limited not more than 40 mm. When the lighting tests are done under such conditions with several kinds of U-shaped tubes 51 having different tube diameter in order to obtain a fluorescent arc tube 50 whose discharge path length is 120 to 200 mm, it was experimentally confirmed that if the fluorescent arc tube 50 is consisted by combining U-shaped tubes 51 within a rage that the tube outer diameter is 5 to 10 mm and the height is 35 to 40 mm, it is able to obtain sufficient optical output and lamp efficiency.

The tube outer diameter of the fluorescent arc tube 50 is restricted not more than 10 mm to set the length of the discharge path more than 120 mm. As a result, the lamp current could be repressed as much as possible and lamp voltage could be increased, so that the lighting circuit efficiency could be enhanced. That is, the more the lamp current is, the more the heat loss of the light circuit module 60 will be. This tendency is remarkable if the lamp power is small. Thus, it is desirable for the lamp 51 with a rated lamp power not more than 12 W that the length of the discharge path of the U-shaped tubes 51 is 120 to 200 mm and the tube outer diameter is not more than 10 mm. Furthermore, if the tube outer diameter is 5 mm or less, the starting voltage rises while the lamp efficiency is deteriorated, in addition, the assembling of the U-shaped tubes 51 will be complicated.

Therefore, the tube outer diameter of the central U-shaped tube 51 should be 5 to 10 mm, and the maximum height be 35 to 40 mm. When the assembling process or light emit tube efficiency are taken into consideration, the maximum height of the U-shaped tube 51 is sometimes desirable to be 30 to 55 mm, however, it is desirable to be 35 to 40 mm if it does not influence to the assembling process or light emit tube efficiency.

When the height H1 of the central U-shaped tube 51 exceeds 40 mm, it is difficult to achieve the same profile as that of the miniaturized incandescent lamp. When it is 35 mm or less, it is difficult to secure the desirable discharge path length.

When the height H2 of both of the sideward U-shaped tubes 51 exceeds 36 mm, it is not able to achieve a sufficient step difference between the height H1 of the central U-shaped tube 51, and also a rotational symmetry of the fluorescent arc tube will be lost. However when the height H2 is less than 30 mm, it is difficult to secure a desirable discharge path length in the fluorescent arc tube 50.

Here, as long as it satisfies the size mentioned above, it may mount three or more U-shaped tubes in parallel, such as adding a central U-shaped tube 51 to have four U-shaped tubes in total.

Thus, the fluorescent arc tube 50 is so constituted that its total luminous flux lamp power is 7 to 12 W, in consideration of its discharge path length, tube outer diameter, phosphor film, gas, and gas pressure as needed so that the total luminous flux is more than 450 lm and lamp efficiency is more than 45 lm/W, more preferably more than 50 lm/W when lighted with the lamp power (the power input across electrode of the light emit tube) 7 to 12W.

In the compact selfballasted fluorescent lamp provided with a fluorescent arc tube 50 constructed as mentioned above, it is able to obtain a light source with almost the same profile and the same light output as those of the miniaturized incandescent lamp.

Furthermore, the mercury content in the main amalgam 90 is 2 to 8%, and the amount of the mercury needed before shipping would be 2 to 4 mg if it is into consideration that the mercury is absorbed and exhausted into the glass or fluorescent substance of the U-shaped tubes 51 during operation.

In order to achieve miniaturization, the distance between the basic portion of the U-shaped tube 51, that is the end portion of the pinch-sealing portion and the circuit board 61 is needed to be shortened, for instance, it is desirable to be shortened to 3.5 mm. Since the fine tube 53 wherein the main amalgam 90 is enclosed is lengthened, it is inserted into the trough-hole 61*c* defined in the circuit board 61.

Each tube end portion of these U-shaped tubes 51 of the fluorescent arc tube 50 is fixed on the holder 40 so that it faces the circuit board 61.

On the circuit board 61, a through-hole 61*c* whose radius is about 3 mm is formed on a desired position near the periphery corresponding to the fine tube 53 wherein the main amalgam 90 is enclosed. On both sides of the circuit board 61 excepting this through-hole 61*c*, two ore more circuit components 62 are mounted, where the inverter lighting circuit for performing the high frequency lighting is constructed. These circuit components 62 include an electrolytic capacitor 63 with relatively low heat resistance and film capacitor. On a printing wiring side 61*b*, a chip-shaped part with relatively high heat resistance and thick package, such as a rectifier, a diode bridge chip, a transistor, or a resistance is mounted.

The luminaire 60 is inserted to the housing 10 from the bottom, and the circuit board 61 of the lighting circuit module 60 is mounted to the lower end of the cup-like portion 13 of the housing 10. The engaging hook of the holder 40 is engaged in the engaging concave 13 formed inside of the fluorescent arc tube module mounting portion 14 of the housing 10, so that the fluorescent arc tube module 30 is mounted on the housing. At that time, the fine tube 53, wherein the main amalgam 90 is enclosed, which projects from the tube end portion of the U-shaped tube 51 of the fluorescent arc tube 50 is inserted, into the through-hole 61*c* of the circuit board 61.

A silicone resin 70 as a thermal conductor is filled in the housing to cover the circuit components 62 mounted on the lighting circuit module 60 and the fine tube 53 of the fluorescent arc tube which projects from the through-hole 61*c* of the circuit board 61. Two electric power supply wires (not shown in figure) lead from the circuit board 61 passes through the bulb-base fitting portion 11 along the electrolytic capacitor 63 to couple to the bulb-base 20, and the lighting circuit module 60 is electrically coupled to the bulb-base 20.

The compact selfballasted fluorescent lamp is formed as mentioned above, whose lamp power is 10 W, has a rating of the tube load of 0.25 W/cm$^2$. Thus, since the are of the inner wall of the fluorescent arc tube 50 per unit lamp power will be remarkably small as the thinned discharge path of the U-shaped tube 51 is elongated, the tube wall load and the ultraviolet-ray intensity the ion shock, and the temperature load per unit area will be high, as a result, the temperature of the fluorescent arc tube 50 will remarkably rises. However, since the heat of the circuit components 62, especially of the electrolytic capacitor 63 is dissipated effectively by the silicone resin 70 filled in the housing 10, so as to prevent the overheating there.

That is, since the overheating of the circuit components 62 is prevented, the reliability of the lighting circuit module 60 is improved. Hereby, the life span of the compact selfballasted fluorescent lamp is improved.

Further, by pouring the silicone resin 70 in the housing 10 from the bulb-base fitting portion 11 formed top part of the housing 10, it is able to fill up the silicone resin 70 in the housing 10 without leaving any space. Furthermore, since the silicone resin 70 poured on the top side of the circuit components 62 flows down toward the components side of the circuit board 61 by its own weight, the filling operation of the silicone resin 70 will be simple. Furthermore, since heat of the circuit component 62 is conducted to the fine tube which is inserted through the through-hole 61*c* of the circuit board 61 via the silicone resin 70, the main amalgam 90 enclosed in the fine tube 53 is warmed, so that the mercury of the main amalgam 90 evaporates quickly, thereby it is able to improve the lighting start-up characteristic.

Since the hardness of the silicone resin 70 after cured is limited in not more than 100 JIS-A, it is able to prevent a problem such as a solder crack that is occurred by that thermal stress caused by the thermal expansion difference between the silicon resin 70 and the circuit component 62 is applied to the circuit components 62. Furthermore, when the hardness of the silicone resin 70 after cured is not more than 100 JIS-A, it is prevent the crack even though the fine tube 53 which protrudes from the circuit board 61 is buried in the silicone resin 70.

On the other hand, since the thermal conductivity tends to be deteriorated as the hardness of the thermal conductor 70 after cured is inferior, the thermal conductor is required to have moderate hardness.

Moreover, by inserting the fine tube 53 through the through-hole 61*c* of the circuit board 61, the length of the compact selfballasted fluorescent lamp in its longitudinal direction will be shortened effectively.

Here, in the compact selfballasted fluorescent lamp of the present embodiment the fluorescent arc tube 50 is covered by the glove 80, however, the glove 80 is not necessarily required for the compact selfballasted fluorescent lamp.

Furthermore, the holder 40 may be made of a metal material.

Figure 10:
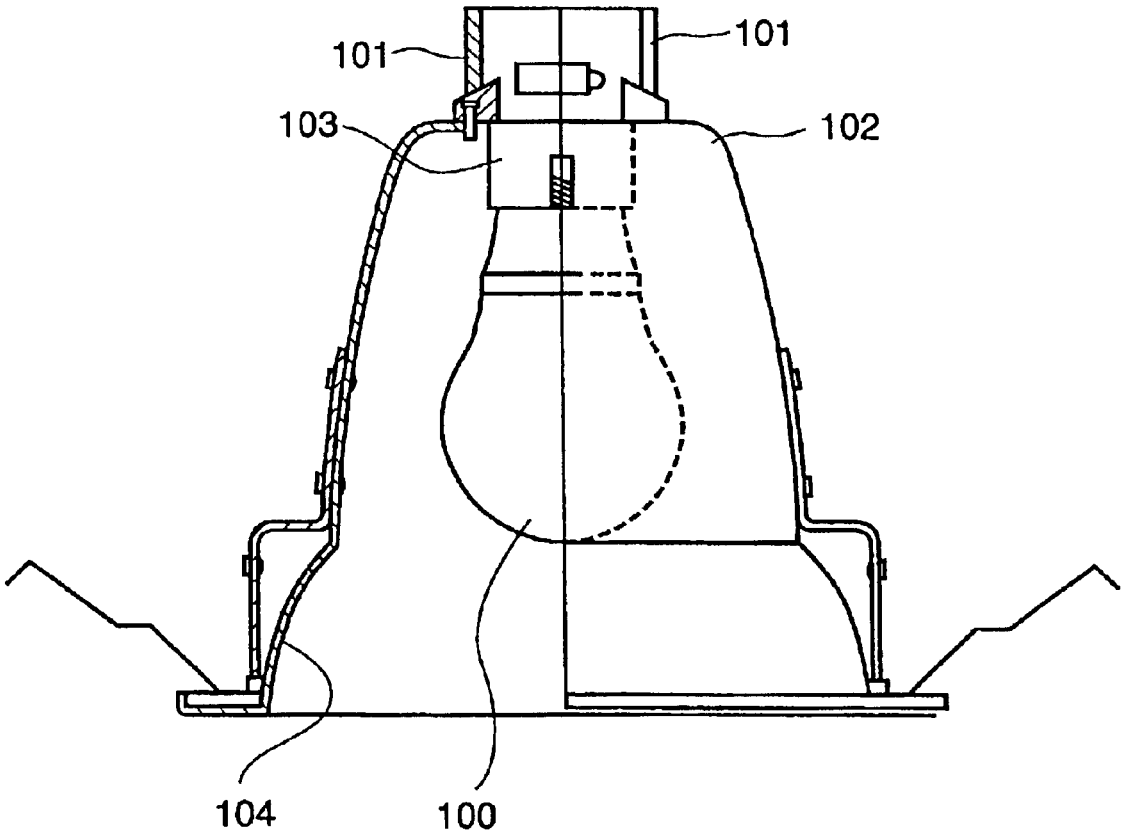
FIG. 10 is a partial section side view of one embodiment of the luminaire according to the present invention.

FIG. 10 is a partial snatched sectional view showing an embodiment of the luminaire according to the present invention.

In FIG. 10, numeral 100 denotes a compact selfballasted fluorescent lamp. Numeral 101 denotes a built-in type luminaire principal body, which is comprised of a basic body 102, a socket 103, and a reflector 104.

According to the first aspect of the invention, at least one of the circuit components mounted on the circuit board of the lighting circuit module is covered with the thermal conductor whose thermal conductivity is more than 0.1 W/(m·K), while the thermal conductor contacts with the inner wall of the housing, thereby it is able to efficiently dissipate heat developed by the circuit components via the thermal conductor.

According to the second aspect of the invention, even though the compact selfballasted fluorescent lamp is miniaturized but high-powered so as that the housing excepting the bulb-base fitting portion has an outer surface area per unit lamp power not exceeding 500 mm$^2$/W, the lighting circuit module is less deteriorated from the heat affection since the thermal conductor filled in the housing which covers at least one of the circuit components of the lighting circuit module and contacts the inner wall of the housing efficiently dissipates heat developed by the lighting circuit module and the fluorescent arc tube.

According to the third aspect of the invention, the compact selfballasted fluorescent lamp is able to reliably dissipate heat in the housing through the thermal conductor and the housing.

According to the fourth aspect of the invention, the compact selfballasted fluorescent lamp is able to fill up the thermal conductor in the space between the circuit components and the housing inner wall without leaving any gap, and also able to prevent the thermal conductor from flowing out of the gap between the circuit board and the fluorescent arc tube holder.

According to the fifth aspect of the invention, since the hardness of the thermal conductor after cured is not more than 100 JIS-A, the thermal stress of the thermal conductor applied to the circuit components lessens even if the thermal conductor expands by heat, thereby it is able to restrain occurrences of failures in the circuit components contacting the thermal conductors.

According to the sixth aspect of the invention, an amount of heat developed by the fluorescent arc tube increases with a miniaturization of the fluorescent arc tube, and the temperature in the housing accommodating the lighting circuit module increases as the miniaturization of the housing. However, by adding a filler more than 0.1% by mass, which is made of at least one of oxide, nitrogen oxide, and oxide hydrogen of one element among a group consisting of aluminum (Al), silicon (Si), titanium (Ti), and magnesium (Mg) to the thermal conductor to be filled in the housing, the thermal conductivity of the thermal conductor in the housing heated to a high temperature gets better, thereby it is able to dissipate heat from the circuit components and the fluorescent arc tube and also able to prevent the heat affection to the lighting circuit.

According to the seventh aspect of the invention, by specifying the monomer and a total content of the oligomer constituent of the thermal conductor to be filled in the housing heated to a high temperature, it is able to restrain the amount of gas generated from the oligomer constituents of the thermal conductor.

According to the eighth aspect of the invention, since at least the contact point of the bulb-base is made of metal with a high thermal conductivity, the dissipation of heat is further heightened by conducting heat from the thermal conductor to the bulb-base.

According to the ninth aspect of the invention, when the thermal conductor and the fine tube of the fluorescent arc tube contact each other, since the heat from the circuit components is conducted to the fine tube via the thermal conductor, the amalgam is wormed quickly, and the mercury evaporates at an early stage right after lighting operation, so that the luminous flux start-up characteristic can be improved.

According to the tenth aspect of the invention, since the thermal conductor covers a portion excepting a safety valve of the electrolysis capacitor, the safety valve is able to be opened in the housing that the lamp is kept lighted at high temperature that exceeds the rated acceptable temperature of the electrolysis capacitor or at the life last stage when the electrolysis liquid of the electrolysis capacitor decreases, thereby it is able to prevent a risk such as a burst.

According to the eleventh aspect of the invention, it is able to provide an inexpensive compact selfballasted fluorescent lamp by using the synthetic resin containing flame retardant.

According to the twelfth aspect of the invention, since all tube ends of the fluorescent lamp are placed so as to face the circuit board, the lighting circuit module which is placed in proximity to the tube ends supporting electrodes thereon tend to be affected by the heat. However, it is able to surpress temperature rise in the housing by the thermal conductor filled in the housing.

According to the thirteenth aspect of the invention, it is able to provide a luminaire which is provided with a compact selfballasted fluorescent lamp having a function of any one of the first to the twelfth aspect of the invention.

While there have been illustrated and described what are at present considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation or material to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

The foregoing description and the drawings are regarded by the applicant as including a variety of individually inventive concepts, some of which may lie partially or wholly outside the scope of some or all of the following claims. The fact that the applicant has chosen at the time of filing of the present application to restrict the claimed scope of protection in accordance with the following claims is not to be taken as a disclaimer or alternative inventive concepts that are included in the contents of the application and could be defined by claims differing in scope from the following claims, which different claims may be adopted subsequently during prosecution, for example, for the purposes of a divisional application.

What is claimed is:

1. A compact self-ballasted fluorescent lamp with dimensions of a total height of 75–105 mm and a maximum diameter of 34–45 mm, comprising:

a fluorescent arc tube forming a crooked discharge path;

a housing comprised of a first end portion open to be fit thereon with a bulb-base, a middle portion and a second end portion open to be mounted thereto with the fluorescent arc tube;

a lighting circuit module accommodated in the housing and constituting a lighting circuit for the fluorescent arc tube, the lighting circuit module provided with a circuit board placed at the second end portion of the housing so as to face the fluorescent arc tube, and two or more circuit components mounted on one side of the circuit board facing inside the housing; and, a thermal conductor having a thermal conductivity of 0.1 W/(m·K) or more, which is filled in the housing in contact with the one side of the circuit board mounting the circuit components of the lighting circuit module thereby covering at least one of the circuit components of the lighting circuit module;

wherein the housing has an outer surface of about 5300 $mm^2$ and an outer surface area per unit lamp power of 500 $mm^2/W$ or less, except the first end portion.

2. A compact self-ballasted fluorescent lamp with dimensions of a total height of 75–105 mm and a maximum diameter of 34–45 mm comprising:

a fluorescent arc tube forming a crooked discharge path;

a housing comprised of a first end portion open to be fit thereon with a bulb-base, a middle portion and a second end portion open to be mounted thereto with the fluorescent arc tube;

a lighting circuit module accommodated in the housing and constituting a lighting circuit for the fluorescent arc tube, the lighting circuit module provided with a circuit board placed at the second end portion of the housing so as to face the fluorescent are tube, and two or more circuit components mounted on one side of the circuit board facing inside the housing; and a thermal conductor having a thermal conductivity of 0.1 W/(m·K) or more, which is filled in the housing in contact with the one side of the circuit board mounting the circuit components of the lighting circuit module thereby covering at least one of the circuit components of the lighting circuit module;

wherein the fluorescent arc tube has a fine tube containing therein an amalgam, and the fine tube contacts with the thermal conductor through a through-hole defined in the circuit board.

3. A compact self-ballasted fluorescent lamp with dimensions of a total height of 75–105 mm and a maximum diameter of 34–45 mm, comprising:

a fluorescent arc tube forming a crooked discharge path;

a housing comprised of a first end portion oven to be fit thereon with a bulb-base, a middle portion and a second end portion oven to be mounted thereto with a fluorescent arc tube;

a lighting circuit module accommodated in the housing and constituting a lighting circuit for the fluorescent arc tube, the lighting circuit module provided with a circuit board placed at the second end portion of the housing so as to face the fluorescent arc tube, and an electrolytic capacitor constituting the lighting circuit mounted on one side of the circuit board facing inside the housing; and a thermal conductor having a thermal conductivity of 0.1 W/(m·K) or more, which is filled in the housing in contact with the one side of the circuit board mounting the circuit components of the lighting circuit module, thereby covering the electrolytic capacitor of the lighting circuit module except a safety valve of the electrolytic capacitor.

4. A compact self-ballasted fluorescent lamp according to claim 1, wherein the fluorescent arc tube is composed of a plurality of U-shaped tubes coupled together, and the fluorescent arc tube is mounted to the housing with tube ends of the plurality of the U-shaped tubes wholly facing the circuit board.

5. A compact self-ballasted fluorescent lamp according to any one of claims 1 to 3, wherein the thermal conductor is filled in the housing further in contact with an inner wall of the first end portion of the housing.

6. A compact self-ballasted fluorescent lamp according to any one of claims 1 to 3, wherein the thermal conductor contacts with more than 30% of an inner wall of the middle portion of the housing.

7. A compact self-ballasted fluorescent lamp according to any one of claims 1 to 3, wherein the thermal conductor is curable and has a viscosity of 10 to 500 Pa·s in being filled in the housing.

8. A compact self-ballasted fluorescent lamp according to any one of claims 1 to 3, wherein the hardness of the thermal conductor after being cured is not more than 100 JIS-A.

9. A compact self-ballasted fluorescent lamp according to any one of claims 1 to 3, wherein the thermal conductor contains a filler more than 0.1% by mass, which is made of oxide, nitrogen oxide, or oxide hydrogen of one element among a group consisting of aluminum (Al), silicon (Si), titanium (Ti), and magnesium (Mg), or a combination of two or more thereof.

10. A compact self-ballasted fluorescent lamp, comprising:

a fluorescent arc tube forming a crooked discharge path;

a housing comprised of a first end portion open to be fit thereon with a bulb-base, a middle portion and a second end portion open to be mounted thereto with a fluorescent arc tube;

a light circuit module provided with two ore more circuit components containing an electrolytic capacitor which constitute a light circuit for turning the fluorescent arc tube on and a circuit board to which these circuit components are mounted, and is accommodated in a housing; and a thermal conductor which is filled in the housing so as to contact with an inner wall of the housing above the upper side of the circuit board of the lighting circuit module, thereby covering the circuit components of the lighting circuit modules excepting a safety valve of an electrolytic capacitor.

11. A compact self-ballasted fluorescent lamp according to any one of claims 1 to 3, wherein the thermal conductor contains oligomers not more than D10 in the total content not exceeding 5000 ppm.

12. A compact self-ballasted fluorescent lamp according to any one of claims 1 to 3, wherein the thermal conductor is filled in the housing in a condition contacting with at least a metal portion of the bulb-base.

13. A self-ballasted fluorescent lamp, according to claim 3, further comprising a holder holding a fluorescent arc tube at the second end portion of the housing and the holder is made of synthetic resin containing flame retardant.

14. A luminaire, comprising:

a compact self-ballasted fluorescent lamp as defined in any one of claims 1 to 3; and a luminaire main body to which the compact self-ballasted fluorescent lamp is mounted.

* * * * *